US007654252B2

(12) United States Patent
Kato et al.

(10) Patent No.: US 7,654,252 B2
(45) Date of Patent: Feb. 2, 2010

(54) AIR-FUEL RATIO CONTROL SYSTEM AND METHOD FOR INTERNAL COMBUSTION ENGINE

(75) Inventors: Naoto Kato, Susono (JP); Shuntaro Okazaki, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 282 days.

(21) Appl. No.: 11/869,129

(22) Filed: Oct. 9, 2007

(65) Prior Publication Data

US 2008/0087259 A1 Apr. 17, 2008

(30) Foreign Application Priority Data

Oct. 16, 2006 (JP) ..... 2006-280962

(51) Int. Cl.
*F02D 41/14* (2006.01)

(52) U.S. Cl. ..... 123/674; 123/672; 60/274

(58) Field of Classification Search ..... 123/672, 123/674; 60/276, 285; 701/101–103, 109
See application file for complete search history.

(56) References Cited

U.S. PATENT DOCUMENTS

| | | | | |
|---|---|---|---|---|
| 6,718,754 | B2 * | 4/2004 | Kobayashi et al. | 60/277 |
| 6,782,695 | B2 * | 8/2004 | Lutz et al. | 60/285 |
| 2002/0173901 | A1 * | 11/2002 | Yoshizawa | 701/109 |
| 2005/0217243 | A1 * | 10/2005 | Kamoto et al. | 60/277 |
| 2005/0284130 | A1 * | 12/2005 | Takubo et al. | 60/285 |
| 2006/0005533 | A1 * | 1/2006 | Takubo | 60/285 |
| 2006/0218898 | A1 * | 10/2006 | Satou et al. | 60/285 |
| 2006/0282211 | A1 * | 12/2006 | Yasui | 701/103 |
| 2007/0017210 | A1 * | 1/2007 | Hirata et al. | 60/274 |
| 2007/0169465 | A1 * | 7/2007 | Nakagawa et al. | 60/276 |
| 2008/0066727 | A1 * | 3/2008 | Kato et al. | 123/703 |

FOREIGN PATENT DOCUMENTS

| | | | |
|---|---|---|---|
| JP | 07-197837 | A | 8/1995 |
| JP | 2000-179384 | A | 6/2000 |
| JP | 2003-241803 | A | 8/2003 |
| JP | 2005-113729 | A | 4/2005 |

* cited by examiner

*Primary Examiner*—Stephen K Cronin
*Assistant Examiner*—Arnold Castro
(74) *Attorney, Agent, or Firm*—Sughrue Mion, PLLC

(57) ABSTRACT

An air-fuel ratio control system includes: a catalyst; an A/F sensor provided upstream of the catalyst; an oxygen concentration sensor provided downstream of the catalyst; an output value estimation portion that estimates the output value of the oxygen concentration sensor using a model related to the catalyst and the oxygen concentration sensor; an integral value calculation portion that calculates an integral value of deviation being updated by integrating the difference between the actual oxygen concentration output value and the estimated output value; a correction value calculation portion that calculates a feedback correction value for the output value of the A/F sensor and a target air-fuel ratio at least based on the integral value of deviation; and an air-fuel ratio control portion that zeros a first deviation that is obtained by correcting the difference between the detected air-fuel ratio and the target air-fuel ratio, using the feedback correction value.

17 Claims, 13 Drawing Sheets

AIR-FUEL RATIO CONTROL SYSTEM AND METHOD FOR INTERNAL COMBUSTION ENGINE

INCORPORATION BY REFERENCE

The disclosure of Japanese Patent Application No. 2006-280962 filed on Oct. 16, 2006 including the specification, drawings and abstract is incorporated herein by reference in its entirety

BACKGROUND OF THE INVENTION

1. Field of the Invention

The invention relates to an air-fuel ratio control system and an air-fuel ratio control method for an internal combustion engine that control the air-fuel ratio of exhaust gas entering a catalyst.

2. Description of the Related Art

An air-fuel ratio control system for an internal combustion engine that controls the air-fuel ratio of exhaust gas entering a catalyst based on the output values of an air-fuel ratio sensor and an oxygen concentration sensor is described in, for example, Japanese Patent Application Publication No. 2005-113729 (JP-A-2005-113729). This air-fuel ratio control system has an air-fuel ratio sensor provided upstream of a catalyst in the exhaust passage of the internal combustion engine and an electromotive force type oxygen concentration sensor provided downstream of the catalyst. According to this air-fuel ratio control system, a feedback correction value is calculated by performing a proportional integral derivative processing (so-called PID processing) to the deviation between the output value of the oxygen concentration sensor and the target value of that output value (corresponding to "target air-fuel ratio"). This deviation will be referred to as "downstream-side deviation" where necessary. Then, feedback control is performed such that the difference between the air-fuel ratio obtained from the output value of the air-fuel ratio sensor corrected by the foregoing feedback correction value and the target air-fuel ratio is controlled to be zero so that the catalyst upstream-side air-fuel ratio equals the target air-fuel ratio.

In general, for example, a deviation (i.e., the variation of detection by the airflow meter) unavoidably arises between the intake air flowrate detected by an airflow meter, which is used to determine the amount of fuel to be injected from the injector, and the actual intake airflow rate, and a deviation (i.e., the variation of injection from the injector) unavoidably arises between the required fuel injection amount that the injector is instructed to inject and the amount of fuel actually injected. Such deviations will be collectively referred to as "error of fuel injection amount". Further, the output value of a limiting-current type oxygen concentration sensor that is typically used as the foregoing air-fuel ratio sensor tends to include an error. Hereinafter, the error of fuel injection amount and the error of the upstream-side air-fuel ratio sensor will be collectively referred to as "intake/exhaust system error" where necessary.

The aforementioned feedback control value includes a value of an integral term, that is, a value obtained by multiplying an integral value of deviation, which is updated by integrating the downstream-side deviation, by a feedback gain. Therefore, even when the intake/exhaust system error occurs, it may be compensated for by the integral term by performing the foregoing feedback control, and therefore the air-fuel ratio may be made equal to the target air-fuel ratio. In other words, the value of the integral term (or the integral value of deviation) may indicate the magnitude of the intake/exhaust system error.

Many air-fuel ratio control systems of this kind perform an integral term learning process in which the value of the integral term (or the integral value of deviation) as mentioned above is recorded while the recorded value of the integral term (will be referred to also as "learning value of the integral term") is repeatedly updated (learned) at given time intervals.

Meanwhile, the value of the integral term (or the learning value of the integral term) converges to the value that accurately represents the magnitude of the intake/exhaust system error (will be referred to as "target convergence value"). If the value of the integral term (or the learning value of the integral term) is equal to the target convergence value, it indicates that an actual air-fuel ratio that is being treated equally as the target air-fuel ratio (will be referred to as "control center air-fuel ratio") by the air-fuel ratio control system, is actually equal to the target air-fuel ratio.

When the control center air-fuel ratio is equal to the target air-fuel ratio, the intake/exhaust system error may be properly compensated for, and thus the air-fuel ratio may be properly controlled to the target air-fuel ratio. Note that, in the case of the system described in JP-A-2005-113729, the fact that the control center air-fuel ratio is equal to the target air-fuel ratio indicates that the air-fuel ratio obtained from the output value of the air-fuel ratio sensor corrected by the feedback correction value is equal to the catalyst upstream-side air-fuel ratio.

On the other hand, when the value of the integral term (or the learning value of the integral term) is deviating from the target convergence value, the control center air-fuel ratio becomes a value deviating from the target air-fuel ratio. In this case, there is a possibility that the intake/exhaust system error is not properly compensated for, and thus the air-fuel ratio is not properly controlled to the target air-fuel ratio. Therefore, it is preferable to maintain the value of the integral term (or the learning value of the integral term) at the target convergence value or at the vicinity of the target convergence value when the control center air-fuel ratio is deviating from the target air-fuel ratio.

However, if external interferences with respect to the air-fuel ratio control, such as the cut-off of fuel supply and an increase in the fuel injection amount, frequently occur, the integral term (or the learning value of the integral term) may deviate from the target convergence value. For example, in the case where the fuel supply is cut off frequently, the air-fuel ratio in the catalyst is biased to the lean side and therefore the oxygen concentration sensor outputs a value corresponding a lean air-fuel ratio. This may cause a problem that the value of the integral term (or the learning value of the integral term) gradually deviates from the target convergence value to make the air-fuel ratio richer.

SUMMARY OF THE INVENTION

The invention provides an air-fuel ratio control system and an air-fuel ratio control method for an internal combustion engine that may prevent the control center air-fuel ratio from deviating from the target air-fuel ratio even when an external interference with respect to the air-fuel ratio control occurs.

An air-fuel ratio control system according to the first aspect of the invention has a catalyst, an air-fuel ratio sensor, an oxygen concentration sensor, an output value estimation portion, an integral value calculation portion, a correction value calculation portion, and an air-fuel ratio control portion.

The catalyst is provided in an exhaust passage of the internal combustion engine, and has a property of storing oxygen.

The air-fuel ratio sensor is provided upstream of the catalyst in the exhaust passage, and outputs a value corresponding to the air-fuel ratio of exhaust gas entering the catalyst.

The oxygen concentration sensor is provided downstream of the catalyst in the exhaust passage, and outputs a value corresponding to the air-fuel ratio of exhaust gas flowing out of the catalyst.

The output value estimation portion estimates the output value of the oxygen concentration sensor using a model related to the catalyst and the oxygen concentration sensor.

The integral value calculation portion calculates an integral value of deviation that is updated by integrating the difference between an actual output value from the oxygen concentration sensor and the estimated output value estimated from the output value estimation portion (will be referred to also as "output value deviation").

The correction value calculation portion calculates, at least based on the integral value of deviation, a feedback correction value to correct at least one of a value corresponding to the output value of the air-fuel ratio sensor and a target air-fuel ratio.

The air-fuel ratio control portion controls a first deviation to be zero using the feedback correction value. The first deviation is obtained by correcting the difference between a detected air-fuel ratio from the air-fuel ratio sensor and the target air-fuel ratio.

An air-fuel ratio control method according to the second aspect of the invention includes; estimating an output value of an oxygen concentration sensor using a model related to the catalyst which is provided in an exhaust passage of the internal combustion engine and the oxygen concentration sensor which is provided downstream of the catalyst; calculating an integral value of deviation which is updated by integrating the difference between an actual output value from the oxygen concentration sensor and the estimated output value; calculating a feedback correction value, at least based on the integral value of deviation, to correct at least one of a value corresponding to the output value of the air-fuel ratio sensor and a target air-fuel ratio; and controlling a first deviation to be zero using the feedback correction value, the first deviation being obtained by correcting the difference between a detected air-fuel ratio from the air-fuel ratio sensor and the target air-fuel ratio.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE EMBODIMENTS

Hereinafter, an air-fuel ratio control system according to example embodiments of the invention will be described with reference to the drawings. In the following descriptions, the air-fuel ratio (actual air-fuel ratio) of exhaust gas entering a catalyst will be referred to as "catalyst upstream-side air-fuel ratio" or simply as "air-fuel ratio" where necessary and appropriate, and an internal combustion engine will be simply referred to as "engine" where necessary and appropriate.

Figure 1:
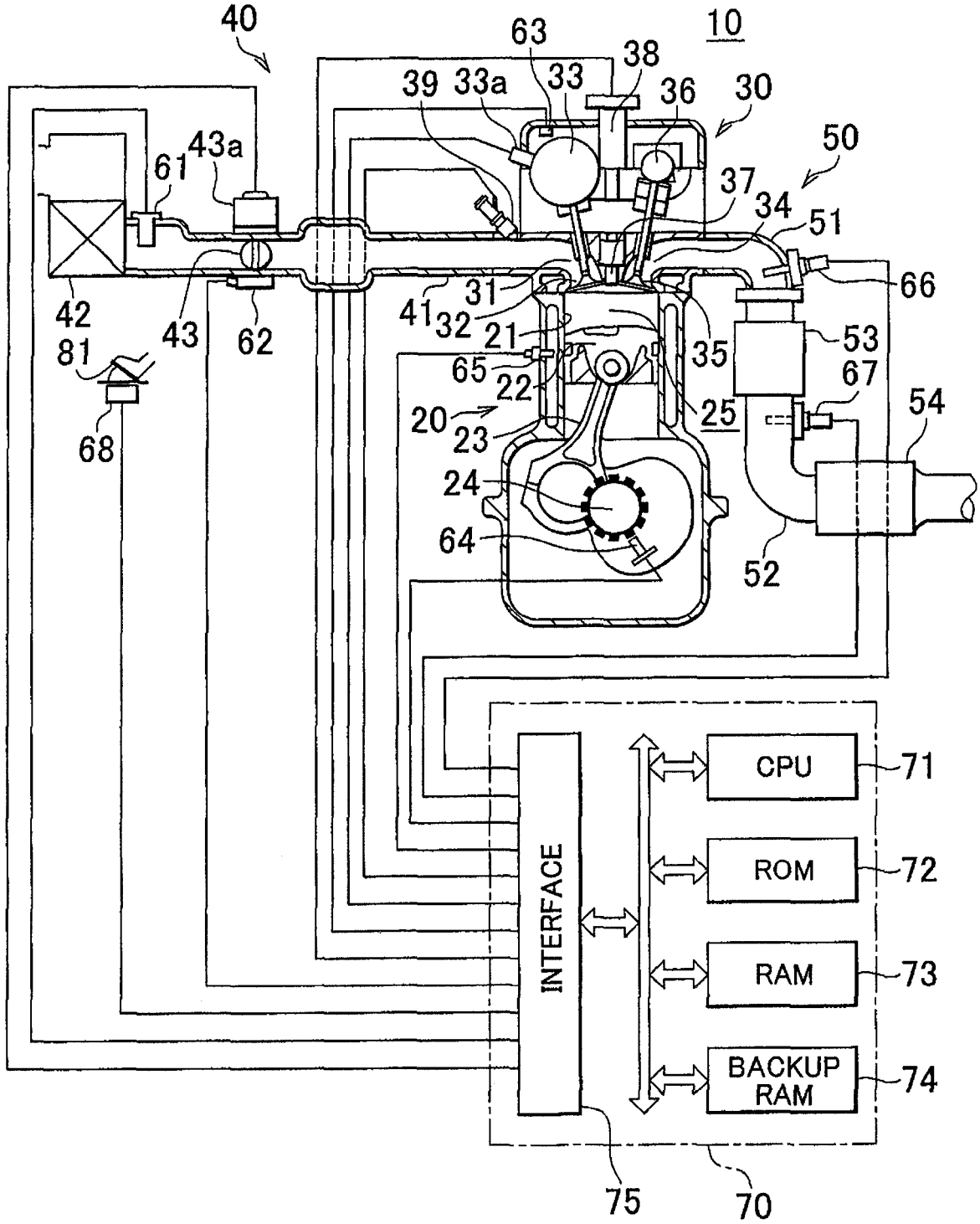
FIG. 1 is a view schematically showing an internal combustion engine incorporating an air-fuel ratio control system according to the first example embodiment of the invention.

FIG. 1 schematically shows the configuration of a spark-ignition type multi-cylinder (four-cylinder) internal combustion engine 10 that incorporates an air-fuel ratio control system according to the first example embodiment of the invention. The internal combustion engine 10 includes: a cylinder block assembly 20 having a cylinder block, a cylinder block lower case, an oil pan, and so on; a cylinder head assembly 30 mounted on the cylinder block assembly 20; an intake system 40 that supplies air-gasoline mixtures to the cylinder block assembly 20; and an exhaust system 50 that discharges exhaust gas from the cylinder block assembly 20 to the outside.

The cylinder block assembly 20 includes cylinders 21, pistons 22, connecting rods 23, and a crankshaft 24. The pistons 22 reciprocate in the respective cylinders 21, and the reciprocation of each piston 22 is transmitted to the crankshaft 24 via the corresponding connecting rod 23, whereby the crankshaft 24 rotates. Combustion chambers 25 are formed by the cylinders 21, the crowns of the pistons 22, and the cylinder head assembly 30.

The cylinder head assembly 30 has intake ports 31 communicating with the respective combustion chambers 25, intake valves 32 for opening and closing the intake ports 31, an intake camshaft for driving the intake valves 32, a variable intake valve timing device 33 that continuously changes the phase angle of the intake camshaft, an actuator 33*a* of the variable intake valve timing device 33, exhaust ports 34 communicating with the respective combustion chambers 25, exhaust valves 35 for opening and closing the exhaust ports 34, an exhaust camshaft 36 for driving the exhaust valves 35, ignition plugs 37, an igniter 38 having an ignition coil that generates high voltage to be supplied to each ignition plug 37, and injectors (fuel injecting means) 39 that inject fuel into the respective intake ports 31.

The intake system 40 has: an intake pipe 41 including an intake manifold that communicates with the respective intake ports 31 and thus forms the intake passage together with the intake ports 31; an air filter 42 provided at one end of the intake pipe 41; a throttle valve 43 provided in the intake pipe 41 to variably change the opening area of the intake passage; and a throttle-valve actuator 43*a*. The intake ports 31 and the intake pipe 41 together form the intake passage.

The exhaust system 50 has an exhaust manifold 51 communicating with the respective exhaust ports 34, an exhaust pipe 52 connected to the exhaust manifold 51 (to the point to which the branch pipes of the exhaust manifold 51 communicating with the respective exhaust ports 34 converge), an upstream catalyst unit 53 provided in the exhaust pipe 52 (three-way catalyst, will be referred to as "first catalyst 53"), and a downstream catalyst unit 54 provided downstream of the first catalyst 53 in the exhaust pipe 52 (three-way catalyst, will be referred to as "second catalyst 54"). The exhaust ports 34, the exhaust manifold 51, and the exhaust pipe 52 together form the exhaust passage.

Further, this system is provided with an air-flow meter 61, a throttle position sensor 62, a cam position sensor 63, a crank position sensor 64, a coolant temperature sensor 65, an air-fuel ratio sensor 66 provided upstream of the first catalyst 53 (at the point to which the branch pipes of the exhaust manifold 51 converge) in the exhaust passage (will be referred to as "AF sensor 66"), an air-fuel ratio sensor 67 provided downstream of the first catalyst 53 and upstream of the second catalyst 54 in the exhaust passage (will be referred to as "oxygen sensor 67"), and an accelerator operation amount sensor 68.

The airflow meter 61 is a known hot-wire airflow meter that outputs voltage corresponding to the mass flowrate of intake air flowing through the intake pipe 41 per unit time (intake air flowrate Ga). The throttle position sensor 62 detects the opening degree of the throttle valve 43 and outputs signals indicating the throttle valve opening degree TA. The cam position sensor 63 outputs a pulse (a G2 signal) each time the intake camshaft turns 90° (each time the crankshaft 24 turns 180°). The crank position sensor 64 outputs a narrow pulse each time the crankshaft 24 turns 10° and a wide pulse each time the crankshaft 24 turns 360°. From these signals, an engine speed NE is determined. The coolant temperature sensor 65 detects the temperature of the coolant of the internal combustion engine 10 and outputs signals indicating a coolant temperature THW.

The AF sensor 66 is a limiting-current type oxygen sensor. As indicated by the solid curve in FIG. 2, the AF sensor 66 outputs current corresponding to the air-fuel ratio A/F and outputs an output value Vabyfs that is the voltage corresponding to the output current. Assuming that the output value Vabyfs of the AF sensor 66 includes no error (will be referred to as "the error of the AF sensor 66"), the output value Vabyfs of the AF sensor 66 equals an upstream-side target value Vstoich when the actual air-fuel ratio upstream of the first catalyst 53 (will be referred to as "catalyst upstream-side air-fuel ratio") is equal to a stoichiometric air-fuel ratio AFth. As is evident from FIG. 2, the AF sensor 66 may accurately detect the air-fuel ratio A/F in a wide range.

Figure 3:
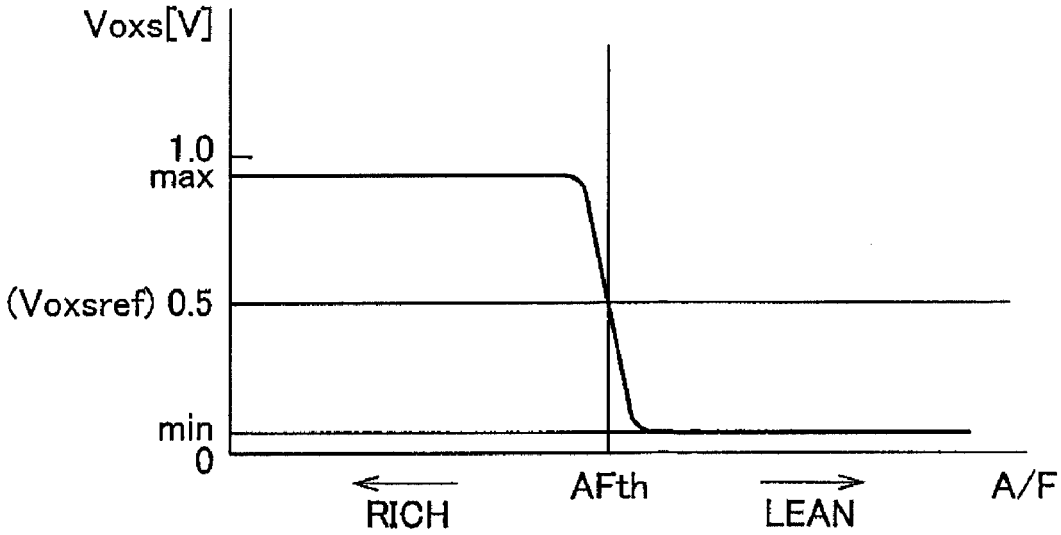
FIG. 3 is a graph illustrating the relation between the output voltage of the downstream-side air-fuel ratio sensor shown in FIG. 1 and the air-fuel ratio.

The oxygen sensor 67 is an electromotive force type oxygen sensor (concentration cell type oxygen sensor) that, as shown in FIG. 3, outputs an output value Voxs that sharply changes near the stoichiometric air-fuel ratio. More specifically, the oxygen sensor 67 outputs approx. 0.1 V (min, will be referred to as "lean value") when the air-fuel ratio is fuel-lean, approx. 0.9 V (max, will be referred to as "rich value") when the air-fuel ratio is fuel-rich, and 0.5 V when the air-fuel ratio is equal to the stoichiometric air-fuel ratio. The accelerator operation amount sensor 68 detects the amount by which the driver is operating the accelerator pedal 81 and outputs signals indicating the operation amount Accp of the accelerator pedal 81.

Further, this system is provided with an electric control unit 70. The electric control unit 70 is a microcomputer constituted of a CPU 71, a ROM 72 storing various routines (programs) executed by the CPU 71, various data tables (look-up tables, maps), various parameters, and so on, a RAM 73 that the CPU 71 uses to temporarily store various data as needed, a back-up RAM (SRAM) 74 that records data when it is powered and holds the recoded data even when it is not powered, an interface 75 including A/D converters, and so on, which are all connected via communication buses. The interface 75 is connected to the foregoing sensors 61 to 68. The interface 75 provides the signals of the sensors 61 to 68 to the CPU 71 and outputs, according to commands from the CPU 71, drive signals to the actuator 33*a* of the variable intake valve timing device 33, the igniter 38, the injectors 39, and the throttle-valve actuator 43*a*.

Next, the outline of the air-fuel ratio control executed by the air-fuel ratio control system of the first example embodiment configured as described above will be described.

The air-fuel ratio control system of the first example embodiment executes two feedback controls; an air-fuel ratio feedback control executed using the output value of the AF sensor 66 (will hereinafter be referred to as "main feedback control") and an air-fuel ratio control that is executed using the output value of the oxygen sensor 67 (will hereinafter be referred to as "sub-feedback control"). Through these feedback controls, the catalyst upstream-side air-fuel ratio is controlled to the stoichiometric air-fuel ratio that is the target air-fuel ratio.

Figure 4:
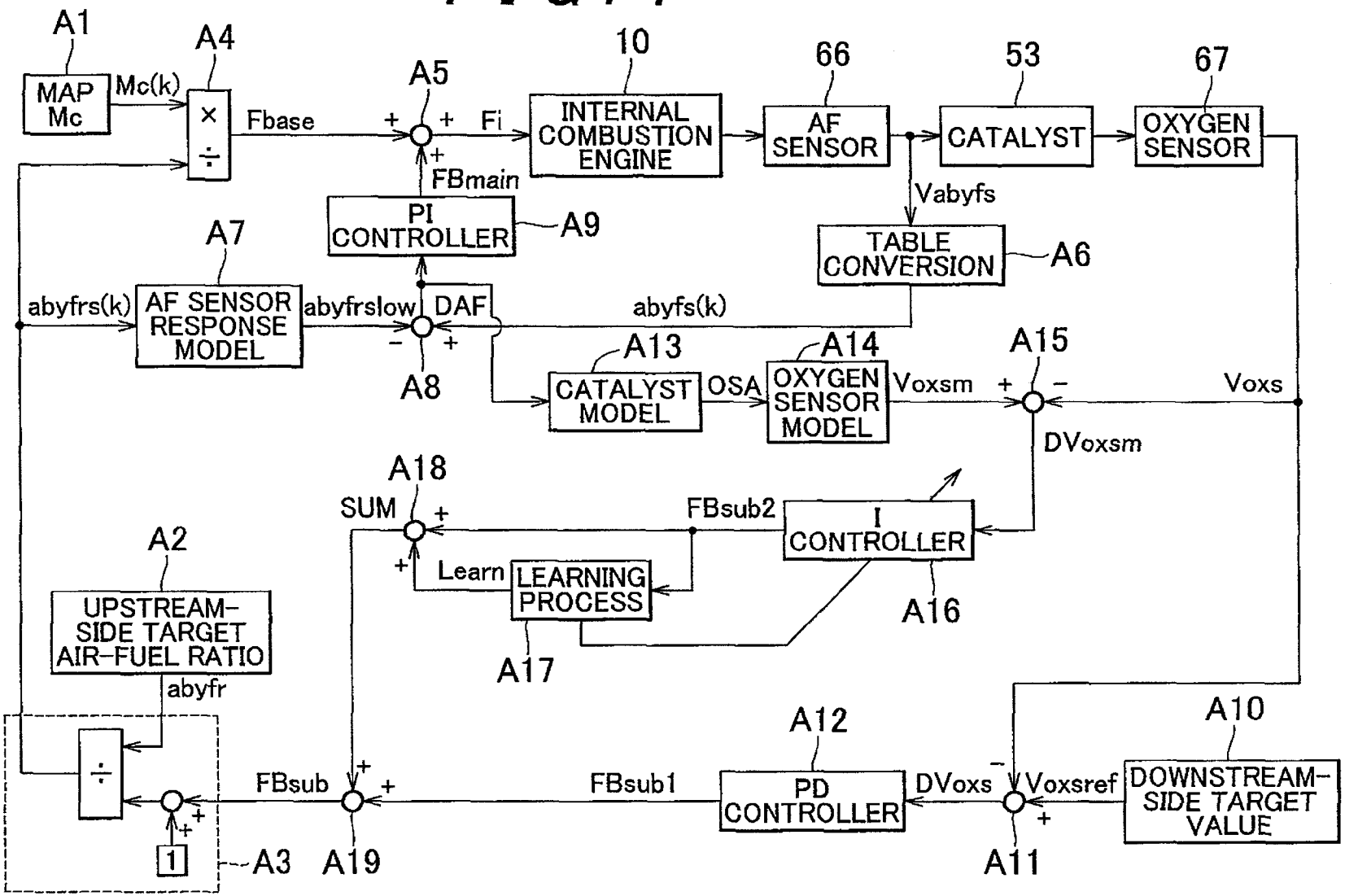
FIG. 4 is a diagram illustrating function blocks used when the air-fuel ratio feedback control according to the first example embodiment is executed.

More specifically, the air-fuel ratio control system of the first example embodiment has function blocks A1 to A19 illustrated in the function block diagram of FIG. 4. In the following, these function blocks will be described with reference to FIG. 4.

First, the calculation of the basic fuel injection amount will be described. In-cylinder intake air amount calculating means A1 obtains an in-cylinder intake air amount Mc(k), which is the amount of intake air newly drawn into the cylinder that is about to undergo an intake stroke in the present cycle. At this time, the in-cylinder intake air amount calculating means A1 determines the in-cylinder intake air amount Mc(k) based on the intake air flowrate Ga detected by the air-flow meter 61, the engine speed NE obtained from the output of the crank position sensor 64, and a table MapMc stored in the ROM 72. The suffix (k) indicates that the determined in-cylinder intake air amount Mc is the value for the intake stroke of the present cycle. Such suffixes will be attached to other physical amounts in this specification. The determined in-cylinder intake air amount Mc is recorded in the ROM 73 by being identified as corresponding to the intake stroke of each cylinder.

Upstream-side target air-fuel ratio setting means A2 determines a target air-fuel ratio abyfr based on the engine speed NE and the throttle opening degree TA, which indicate the operation state of the internal combustion engine 10. After the internal combustion engine 10 has been warmed up, for example, the target air-fuel ratio abyfr is set to the stoichiometric air-fuel ratio except in some specific circumstances.

Control target air-fuel ratio setting means A3 sets a control target air-fuel ratio abyfrs(k) based on the target air-fuel ratio abyfr and a sub-feedback correction amount FBsub, which is calculated by sub-feedback correction amount calculating means A19 described later, as indicated by the following expression (1).

$$abyfrs(k)=abyfr/(1+FB\text{sub}) \quad (1)$$

As is evident from the above expression (1), the control target air-fuel ratio abyfrs(k) is set to an air-fuel ratio that is higher or lower than the target air-fuel ratio abyfr by an amount corresponding to the sub-feedback correction amount FBsub. This control target air-fuel ratio abyfrs is recorded in the ROM 73 by being identified as corresponding to the intake stroke of each cylinder.

Basic fuel injection amount calculating means A4 obtains a basic fuel injection amount Fbase that corresponds to the in-cylinder intake air amount Mc(k) and is set so as to achieve the control target air-fuel ratio abyfrs(k). The basic fuel injection amount Fbase is calculated by dividing the in-cylinder intake air amount Mc(k) by the control target air-fuel ratio abyfrs(k). As such, the control target air-fuel ratio abyfrs(k) is used to set the basic fuel injection amount Fbase and also used in the main feedback control as will be described later.

Required fuel injection amount calculating means A5 calculates a required fuel injection amount Fi by adding a main feedback correction amount FBmain, which is calculated by main feedback correction amount calculating means (proportion-integration controller) A9 as will be described later, to the basic fuel injection amount Fbase as indicated by the following expression (2).

$$Fi=F\text{base}+FB\text{main} \quad (2)$$

The air-fuel ratio control system of the first example embodiment outputs an injection command to the injector 39 for the cylinder that is about to undergo an intake stroke in the present cycle such that it injects fuel of the required fuel injection amount Fi calculated as described above. Thus, the main feedback control and the sub-feedback control are achieved as will be described later.

Hereinafter, the main feedback control will be described. Table converting means A6 obtains the value of a detected air-fuel ratio abyfs(k) in the cycle corresponding to the time the AF sensor 66 makes a detection (more specifically, the time at which a fuel injection command for injecting fuel of the required fuel injection amount Fi of the corresponding cycle starts to be issued), based on the output value Vabyfs of the AF sensor 66 and the table shown in FIG. 2 which, as mentioned above, defines the relation between the AF sensor output value Vabyfs and the air-fuel ratio A/F (Refer to the solid curve in FIG. 2). The detected air-fuel ratio abyfs is recorded in the RAM 73 by being identified as corresponding to the intake stroke of each cylinder.

An AF sensor response model A7 is a model simulating the delay of the AF sensor output value Vabyfs and having target air-fuel ratio delaying means and a low-pass filter. The target air-fuel ratio delaying means reads out, from among the values of the control target air-fuel ratio abyfrs that have been obtained by the control target air-fuel ratio setting means A3 on each intake stroke and recorded in the ROM 73, the value that was obtained N strokes (N times of intake strokes) before the present time, and the target air-fuel ratio delaying means then sets the read value as a control target air-fuel ratio abyfrs (k-N). "N" represents the number of strokes corresponding to the time that is taken before the air-fuel ratio of exhaust gas produced from combustion of fuel injected in response to a fuel injection command, is detected by the AF sensor 66 (the detection portion of the AF sensor 66) after the same fuel injection command is issued (will hereinafter be referred to as "delay time L"). In the following, the delay time L and the stroke number N will be described in more detail.

In general, a command for injecting fuel is issued during each intake stroke (or before each intake stroke), and the injected fuel is ignited (combusted) in each combustion chamber 25 at a time point close to the compression stroke top dead center that comes after the intake stroke. The produced exhaust gas is discharged from the combustion chamber 25 to the exhaust passage via the surrounding of the corresponding exhaust valve 35. Then, the exhaust gas reaches the AF sensor 66 (the detection portion of the AF sensor 66) as it moves in the exhaust passage.

As such, the delay time L is expressed as the sum of strokes delay and a transfer delay (i.e., the delay related to the movement of the exhaust gas in the exhaust passage). That is, the detected air-fuel ratio abyfs detected by the AF sensor 66 indicates the air-fuel ratio of the exhaust gas produced from the fuel injection command issued the delay time L ago.

The time of the above-stated stroke delay tends to decrease as the engine speed NE increases. The time of the above-stated transfer delay tends to decrease as the engine speed NE increases and as the in-cylinder intake air amount Mc increases. Thus, the stroke number N corresponding to the delay time L decreases as the engine speed NE increases and as the in-cylinder intake air amount Mc increases.

The low-pass filter is a primary digital filter having a time constant $\tau$ that is equal to a time constant corresponding to the response delay of the AF sensor 66. The control target air-fuel ratio abyfrs(k-N) is input to the low-pass filter, and the low-pass filter outputs, in turn, a low-pass-filter-processed control target air-fuel ratio abyfrslow that is obtained by performing a low-pass filtering to the control target air-fuel ratio abyfrs (k-N) using the time constant $\tau$.

Upstream-side air-fuel ratio deviation calculating means A8 obtains the value of an upstream-side air-fuel ratio deviation DAF that was obtained N strokes before the present time, by subtracting the low-pass-filter-processed control target air-fuel ratio abyfrslow from the detected air-fuel ratio abyfs (k) of the present cycle, as indicated by the expression (3) shown below. The upstream-side air-fuel ratio deviation DAF may be regarded as "first deviation".

$$DAF=abyfs(k)-abyfrs\text{low} \quad (3)$$

The reason why the low-pass-filter-processed control target air-fuel ratio abyfrslow is subtracted from the detected air-fuel ratio abyfs(k) of the present cycle to determine the upstream-side air-fuel ratio deviation DAF established N strokes before the present time as described above is that, as mentioned above, the detected air-fuel ratio abyfs(k) of the present cycle indicates the air-fuel ratio of the exhaust gas produced from the injection command issued the delay time L before the present time (i.e., N strokes before the present time). The upstream-side air-fuel ratio deviation DAF is a value corresponding to the excess and deficiency of fuel supplied to the corresponding cylinder N strokes before the present time.

Main feedback correction amount calculating means A9 (proportion-integration controller) obtains a main feedback correction amount FBmain for compensating for the excess and deficiency of the amount of fuel supplied N strokes ago by performing a proportional integral processing to the upstream-side air-fuel ratio deviation DAF, as indicated by the expression (4) shown below.

$$FB\text{main}=Gp\times DAF+Gi\times SDAF \quad (4)$$

In the expression (4), "Gp" is a preset proportional gain (proportional constant), "Gi" is a preset integral gain (integral constant), and "SDAF" is an integral value (accumulated value) of the upstream-side air-fuel ratio deviation DAF.

The air-fuel ratio control system of the first example embodiment obtains the main feedback correction amount FBmain as described above. When obtaining the required fuel injection amount Fi, as mentioned above, the main feedback correction amount FBmain is added to the basic fuel injection amount Fbase. Thus, the main feedback control is performed as follows.

For example, when the catalyst upstream-side air-fuel ratio has varied toward the lean side, the detected air-fuel ratio abyfs(k) becomes leaner (larger) than the low-pass-filter-processed control target air-fuel ratio abyfrslow, and therefore the upstream-side air-fuel ratio deviation DAF becomes a positive value and therefore the main feedback correction amount FBmain becomes a positive value. Thus, the required fuel injection amount Fi(k) becomes larger than the basic fuel injection amount Fbase, and the air-fuel ratio is therefore controlled toward the rich side. As a result, the detected air-fuel ratio abyfs(k) decreases, that is, the detected air-fuel ratio abyfs(k) is controlled such that it equals the low-pass-filter-processed control target air-fuel ratio abyfrslow.

On the other hand, when the catalyst upstream-side air-fuel ratio has varied toward the rich side, the detected air-fuel ratio abyfs(k) becomes richer (i.e., smaller) than the low-pass-filter-processed control target air-fuel ratio abyfrslow, and therefore the upstream-side air-fuel ratio deviation DAF becomes a negative value and therefore the main feedback correction amount FBmain becomes a negative value. Thus, the required fuel injection amount Fi(k) becomes smaller than the basic fuel injection amount Fbase, and the air-fuel ratio is therefore controlled toward the lean side. As a result, the detected air-fuel ratio abyfs(k) increases, that is, the detected air-fuel ratio abyfs(k) is controlled such that it equals the low-pass-filter-processed control target air-fuel ratio abyfrslow. In this way, the main feedback control controls the required fuel injection amount Fi such that the detected air-fuel ratio abyfs(k) equals the low-pass-filter-processed control target air-fuel ratio abyfrslow (i.e., such that the upstream-side air-fuel ratio deviation DAF becomes zero). The means for controlling the catalyst upstream-side air-fuel ratio as described above may be regarded as "air-fuel ratio controlling means" of the invention.

Further, because the main feedback correction amount FBmain includes the integral term Gi×SDAF, it is ensured that the upstream-side air-fuel ratio deviation DAF becomes zero in a steady state. In other words, even when an error in the fuel injection amount, such as described above, is occurring as a result of the main feedback control, it is ensured that, in a steady state, the value of the integral term Gi×SDAF converges to the value corresponding to the magnitude of the error in the fuel injection amount, and the detected air-fuel ratio abyfs(k) converges to the low-pass-filter-processed control target air-fuel ratio abyfrslow (i.e., the upstream-side air-fuel ratio deviation DAF becomes zero). As such, the main feedback control compensates for the error in the fuel injection amount.

Next, the sub-feedback control will be described. Downstream-side target value setting means A10 determines a downstream-side target value Voxsref (corresponding to "reference value corresponding to the target air-fuel ratio") based on the operation state of the internal combustion engine 10 that is determined from the engine speed NE, the throttle opening degree TA, and so on, as the upstream-side target air-fuel ratio setting means A2 determines the target air-fuel ratio abyfr. After the internal combustion engine 10 has been warmed up, for example, the downstream-side target value Voxsref is set to 0.5 (V) corresponding to the stoichiometric air-fuel ratio except in some specific circumstances (Refer to FIG. 3). Further, in this example embodiment, the downstream-side target value Voxsref is set such that the air-fuel ratio corresponding to the downstream-side target value Voxsref is always equal to the target air-fuel ratio abyfr.

Downstream-side deviation calculating means A11 obtains a downstream-side deviation DVoxs by subtracting the present output value Voxs of the oxygen sensor 67 (more specifically, the output value Voxs of the oxygen sensor 67 obtained when a command for injecting fuel of the required fuel injection amount Fi starts to be issued) from the downstream-side target value Voxsref, as indicated by the following expression (5).

$$DVoxs=Voxs\text{ref}-Voxs \quad (5)$$

A proportion-derivation controller A12 (proportional-derivative term calculating means) obtains a proportion-derivation correction amount FBsub1 by performing a proportional derivative processing to the downstream-side deviation DVoxs as indicated by the expression (6) shown below.

$$FB\text{sub}1=Kp\times DVoxs+Kd\times DDVoxs \quad (6)$$

In the expression (6), "Kp" is a preset proportional gain (proportional constant) and "Kd" is a preset derivative gain (derivative constant). "DDVox" is a time derivative value of the downstream-side deviation DVoxs. "Kp×DVoxs" is a proportional term and "Kd×DDVoxs" is a derivative term.

A catalyst model A13 reads in the upstream-side air-fuel ratio deviation DAF (corresponding to "first deviation") obtained by the upstream-side air-fuel ratio deviation calculating means A8 and estimates (updates) the oxidization storage amount OSA, which is the amount of oxygen stored in the first catalyst 53, as indicated by the following expression (7) each time the program described later is executed.

$$OSA=\Sigma(0.23\times DAF\times Fi)(0\leqq OSA\leqq \text{Cmax}) \quad (7)$$

In the expression (7), "0.23" is the mass ratio of oxygen in air and "0.23×DAF×Fi" represents the excess and deficiency of oxygen in the exhaust gas entering the first catalyst 53 per injection of fuel, which is obtained from the upstream-side air-fuel ratio deviation DAF, and "Cmax" represents the maximum capacity of oxygen that the first catalyst 53 can store (maximum oxygen storage capacity). The maximum oxygen storage capacity Cmax, for example, may be determined and updated at given time intervals using a method known in the art.

During the cut-off of fuel supply, the catalyst model A13 estimates (updates) the oxygen storage amount OSA of the first catalyst 53 using the expression (8) shown below instead of the expression (7). In the expression (8), "Δt" represents the time interval at which the program described later is repeatedly executed and "0.23×Ga×Δt" represents the amount of oxygen contained in the exhaust gas (air) entering the first catalyst 53 per the same program execution interval. During the suspension of fuel supply, the oxygen storage amount OSA is increased by the expression (8) up to the maximum oxygen storage capacity Cmax as the upper limit.

$$OSA=\Sigma(0.23\times Ga\times\Delta t)(0\leqq OSA\leqq C\max) \quad (8)$$

Figure 5:
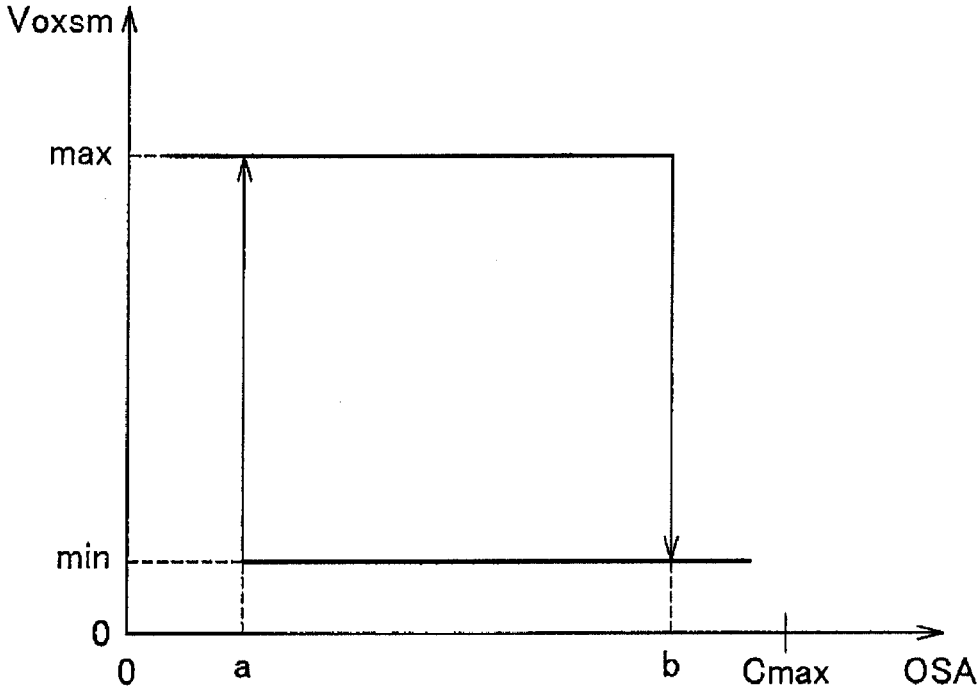
FIG. 5 is a graph illustrating the output characteristic of the oxygen sensor model of the first example embodiment.

An oxygen sensor model A14 reads in the oxygen storage amount OSA estimated by the catalyst model A13 and estimates (updates) an estimated output value Voxsm, which is the estimated output value of the oxygen sensor 67, based on the output characteristic shown in FIG. 5. The estimated output value Voxsm is set to the lean value min or to the rich value max. That is, the estimated output value Voxsm is inverted from the rich value max to the lean value min when the oxygen storage amount OSA has exceeded a first reference value β that is slightly smaller than the maximum oxygen stroke capacity Cmax, and the estimated output value Voxsm is inverted from the lean value min to the rich value max when the oxygen storage amount OSA has fallen below a second reference value $\alpha(0<\alpha<\beta)$. Note that the output characteristic shown in FIG. 5 corresponds to the characteristic of the actual output value Voxs of the oxygen sensor 67 with respect to the actual amount of oxygen stored in the first catalyst 53. The catalyst model A13 and the oxygen sensor model A14 may be regarded as "output value estimating means" of the invention.

Output value deviation calculating means A15 obtains an output value deviation DVoxsm by subtracting the present output value Voxs of the oxygen sensor 67 from the present estimated output value Voxsm (more specifically, these output value Voxs and estimated output value Voxsm are the values obtained when a command for injecting fuel of the required fuel injection amount Fi for the present cycle starts to be issued) and then multiplying the difference with a coefficient Km as indicated by the expression (9) shown below. Note that the coefficient Km is obtained based on the table shown in FIG. 6.

$$DVoxsm=(Voxsm-Voxs)\times Km \quad (9)$$

Thus, the output value deviation DVoxsm is set to a value equal to the difference between the estimated output value Voxsm and the output value Voxs when the output value Voxs is out of the range of c to d including the downstream-side target value Voxsref, and the output value deviation DVoxsm is set to zero when the output value Voxs is in the range of c to d.

An integration controller A16 (integral term calculating means) obtains an integral correction amount (integral term) FBsub2 by performing an integral processing to the output value deviation DVoxsm as indicated by the expression (10) shown below. In the expression (10), "Ki" is a preset integral gain (integral constant) and "SDVoxsm" is an integral value of deviation that is a "time integral value (accumulated value) of the output value deviation DVoxsm" that is updated by integrating the output value deviation DVoxsm. Thus, the integral value of deviation SDVoxsm is not updated when the output value Voxs is within the range of c to d and the output value deviation DVoxsm is zero. The integration controller A16 may be regarded as "integral value calculating means" of the invention.

$$FB\text{sub}2=Ki\times SDVoxsm \quad (10)$$

Learning means A17, as will be described later, transfers steady components of the integral term FBsub2 to a learning value Learn for the integral term FBsub2 (recorded in the RAM 74) each time the time for executing a learning process of the integral term FBsub2 becomes. That is, the sum of the integral term FBsub2 and the learning value Learn does not change as a result of the learning process of the integral term FBsub2. The sum of the integral term FBsub2 and the learning value Learn practically serves as an integral term in the sub-feedback control.

Total sum calculating means A18 calculates a total sum SUM that is the sum of the integral term FBsub2 and the learning value Learn. The total sum SUM, as mentioned above, practically serves as an integral term in the sub-feedback control.

Sub-feedback correction amount calculating means A19 obtains a sub-feedback correction amount FBsub by adding the total sum SUM to the proportion-derivation correction amount FBsub1 as indicated by the expression (11) shown below ($-1<FB\text{sub}<1$). As such, the sub-feedback correction amount FBsub is made equal to the sum of the value obtained by performing a proportional derivative processing to the downstream-side deviation DVoxs (FBsub1) and the value obtained by performing an integral processing to the output value deviation DVoxsm (SUM).

$$FB\text{sub}=FB\text{sub}1+\text{SUM} \quad (11)$$

Thus, the air-fuel ratio control system of the first example embodiment is characterized in that the catalyst model A13 and the oxygen sensor model A14 are incorporated to calculate the estimated output value Voxsm and the output deviation value DVoxsm when calculating the sub-feedback correction amount FBsub and that the integral term (=the total sum SUM) is calculated by performing an integral processing to the output value deviation DVoxsm instead of the downstream-side deviation DVoxs. The advantages obtained from these characteristics will be described in detail later. The sub-feedback correction amount calculating means A19 may be regarded as "correction value calculating means" of the invention.

Referring back to FIG. 4, as mentioned above, the sub-feedback correction amount FBsub is used to set the control target air-fuel ratio abyfrs(k). In addition, the control target air-fuel ratio abyfrs(k) set based on the sub-feedback correction amount FBsub is used in the main feedback control. Thus, the sub-feedback control is performed so as to complement (correct) the main feedback control as will be described below.

For example, when the air-fuel ratio of the exhaust gas downstream of the first catalyst 53 becomes lean, the oxygen sensor output value Voxs indicates the lean value. Then, the downstream-side deviation DVoxs becomes a positive value (Refer to FIG. 3), and therefore the sub-feedback correction amount FBsub becomes a positive value. Thus, the control target air-fuel ratio abyfrs(k) (i.e., the low-pass-filter-processed control target air-fuel ratio abyfrslow) is set to a ratio smaller than the target air-fuel ratio abyfr (=the stoichiometric air-fuel ratio), that is, to a certain rich value. As the main feedback control is performed in this state such that the upstream-side air-fuel ratio deviation DAF becomes zero, the required fuel injection amount Fi is increased so that the air-fuel ratio is controlled toward the rich side. As a result, the oxygen sensor output value Voxs is made equal to the downstream-side target value Voxsref.

On the other hand, when the air-fuel ratio of the exhaust gas downstream of the first catalyst 53 becomes rich, the oxygen sensor output value Voxs indicates a rich air-fuel ratio. Then, the downstream-side deviation DVoxs becomes a negative value, and therefore the sub-feedback correction amount FBsub becomes a negative value. Thus, the control target air-fuel ratio abyfrs(k) (i.e., the low-pass-filter-processed control target air-fuel ratio abyfrslow) is set to a value larger than the target air-fuel ratio abyfr (=the stoichiometric air-fuel ratio), that is, to a certain lean value. As the main feedback control is performed in this state such that the upstream-side air-fuel ratio deviation DAF becomes zero, the required fuel injection amount Fi is reduced so that the air-fuel ratio is controlled toward the lean side. As a result, the oxygen sensor output value Voxs is made equal to the downstream-side target value Voxsref. As such, the sub-feedback control controls the required fuel injection amount Fi such that the oxygen sensor output value Voxs equals the downstream-side target value Voxsref Further, because the sub-feedback correction amount FBsub also includes an integral term (i.e., the total sum SUM that practically serves as an integral term), even when an error of the AF sensor 66 is occurring, performing the sub-feedback control ensures that the value of the total sum SUM converges to a value corresponding to the magnitude of the error of the AF sensor 66 (which corresponds to "target convergence value"), whereby the error of the AF sensor 66 is compensated for, as will be described later.

Meanwhile, because the basic fuel injection amount calculating means A4 calculates the basic fuel injection amount Fbase using the control target air-fuel ratio abyfrs instead of the target air-fuel ratio abyfr and the AF sensor response model A7 is provided, when the sub-feedback correction amount FBsub is deviating from a proper value for some reason, the main feedback correction amount FBmain is prevented from deviating increasingly with time, whereby an increase in the deviation of the catalyst upstream-side air-fuel ratio is suppressed. This effect is described in detail in Japanese Patent Application No. 2005-338113.

Meanwhile, when the oxygen sensor output value Voxs remains equal to the downstream-side target value Voxsref, the proportional term Kp×DVoxs and the derivative term Kd×DDVoxs of the sub-feedback correction amount FBsub are both zero, and therefore the sub-feedback correction amount FBsub is equal to the total sum SUM. In this state, if the total sum SUM is presently equal to the value corresponding to the magnitude of the error of the AF sensor 66 (target convergence value), the control target air-fuel ratio abyfrs (=abyfr×(1+FBsub)=abyfr/(1+SUM)) equals the value of the detected air-fuel ratio abyfs of the AF sensor 66 that is obtained from the corresponding output value Vabyfs of the AF sensor 66 when the catalyst upstream-side air-fuel ratio is equal to the target air-fuel ratio abyfr (=the stoichiometric air-fuel ratio AFth).

Figure 2:
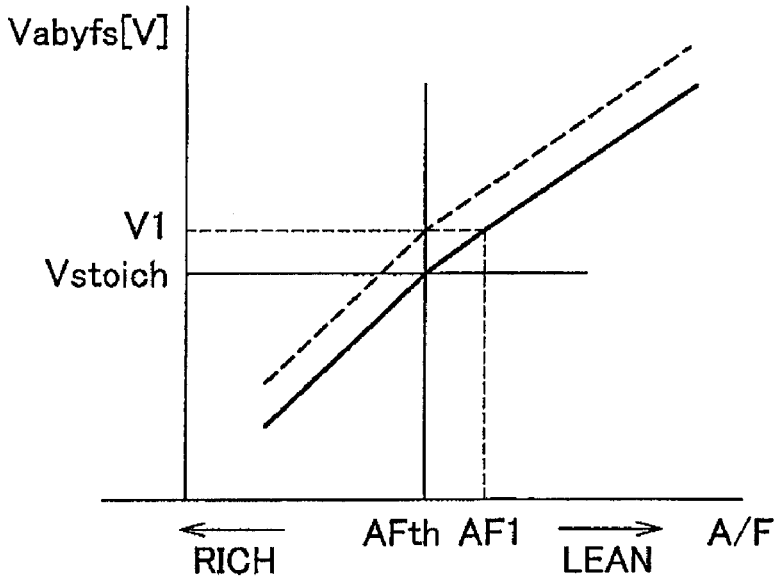
FIG. 2 is a graph illustrating the relation between the output voltage of the upstream-side air-fuel ratio sensor shown in FIG. 1 and the air-fuel ratio.

For more detail, a description will be made of a case where the AF sensor 66 has the output characteristic indicated by the broken curve in FIG. 2 due to an error of the AF sensor 66. In this case, the value of the detected air-fuel ratio abyfs of the AF sensor 66 corresponding to the state where the catalyst upstream-side air-fuel ratio is equal to the target air-fuel ratio abyfr, that is, to the stoichiometric air-fuel ratio AFth (Vabyfs=V1) is AF1 (the air-fuel ratio obtained from the solid curve of FIG. 2 with respect to V1).

In this case, if the total sum SUM is presently equal to the value corresponding to the magnitude of the error of the AF sensor 66 (target convergence value), the control target air-fuel ratio abyfrs (=abyfr/(1+SUM)) equals AF1. As the main feedback control is performed in this state such that the upstream-side air-fuel ratio deviation DAF becomes zero, the catalyst upstream-side air-fuel ratio is controlled to the target air-fuel ratio abyfr (=the stoichiometric air-fuel ratio AFth). In this case, a target convergence value L1 for the total sum SUM, which corresponds to the magnitude of the error of the AF sensor 66, is 1−AF1/abyfr (<0).

That is, if the total sum SUM is equal to the target convergence value L1, it indicates that the actual air-fuel ratio that the air-fuel ratio control system of the first example embodiment treats as an air-fuel ratio equal to the target air-fuel ratio abyfr (=the stoichiometric air-fuel ratio AFth) (will be referred to as "control center air-fuel ratio AFcen") is actually equal to the target air-fuel ratio abyfr (=the stoichiometric air-fuel ratio AFth).

In other words, as the upstream-side air-fuel ratio deviation DAF is controlled to zero by the main feedback control, the catalyst upstream-side air-fuel ratio is controlled to the control center air-fuel ratio AFcen. When the control center air-fuel ratio AFcen is equal to the target air-fuel ratio abyfr (=the stoichiometric air-fuel ratio AFth), the catalyst upstream-side air-fuel ratio is equal to the target air-fuel ratio abyfr (=the stoichiometric air-fuel ratio AFth). As such, the error of the AF sensor 66 is properly compensated for.

Hereinafter, the effects obtained by calculating the integral term (=the total sum SUM) by performing an integral processing to the output value deviation DVoxsm instead of the downstream-side deviation DVoxs. As mentioned above, in the case where the control center air-fuel ratio AFcen is equal to the target air-fuel ratio abyfr (=the stoichiometric air-fuel ratio AFth) (i.e., in the case where the total sum SUM is equal to the target convergence value L1), as the upstream-side air-fuel ratio deviation DAF is controlled to zero by the main feedback control, the catalyst upstream-side air-fuel ratio is controlled to the control center air-fuel ratio AFcen (=the stoichiometric air-fuel ratio AFth).

In this case, therefore, 0.23×DAF×Fi, which represents the excess and deficiency of oxygen in the exhaust gas entering the first catalyst 53 per injection of fuel and is used by the catalyst model A13 (i.e., in the expression (7)), becomes equal to the excess and deficiency of oxygen in the exhaust gas actually entering the first catalyst 53 per injection of fuel. As a result, the variation of the oxygen storage amount OSA that is estimated by the catalyst model A13 coincides with the variation of the actual oxygen storage amount OSAact of the first catalyst 53, and therefore the variation of the estimated output value Voxsm estimated by the oxygen sensor model A14 coincides with the variation of the actual output value Voxs of the oxygen sensor 67.

That is, even if an external interference, such as the cut-off of fuel supply, occurs to the air-fuel ratio control, the estimated output value Voxsm continues to be maintained at zero or at a value near zero and therefore the total sum SUM does not (is unlikely to) deviate from the target convergence value L1.

More specifically, when the control center air-fuel ratio AFcen is equal to the target air-fuel ratio abyfr (=the stoichiometric air-fuel ratio AFth), even if an external interference, such as the cut-off of fuel supply, occurs to the air-fuel ratio control, the total sum SUM does not deviate from the target convergence value L1, and therefore the control center air-fuel ratio AFcen does not deviate from the target air-fuel ratio abyfr (=the stoichiometric air-fuel ratio AFth).

On the other hand, when the total sum SUM is deviating from the target convergence value L1, the control center air-fuel ratio AFcen becomes a value deviating from the upstream-side target air-fuel ratio abyfr (=the stoichiometric air-fuel ratio AFth). In this case, as the upstream-side air-fuel ratio deviation DAF is controlled to zero by the main feedback control, the catalyst upstream-side air-fuel ratio is controlled to the control center air-fuel ratio AFcen (an air-fuel ratio deviating from the target air-fuel ratio abyfr).

As such, 0.23×DAF×Fi becomes unequal to the excess and deficiency of oxygen in the exhaust gas actually entering the first catalyst 53 per injection of fuel. As a result, the variation of the oxygen storage amount OSA becomes different from the variation of the actual oxygen storage amount OSAact, and therefore the variation of the estimated output value Voxsm becomes different from the variation of the oxygen sensor output value Voxs. This will be described in detail with reference to FIG. 7. Note that, in the following description, it is assumed that, as in the case described above, an error of the AF sensor 66 is occurring and therefore the output characteristic of the AF sensor 66 is as indicated by the broken curve in FIG. 2.

Figure 7:
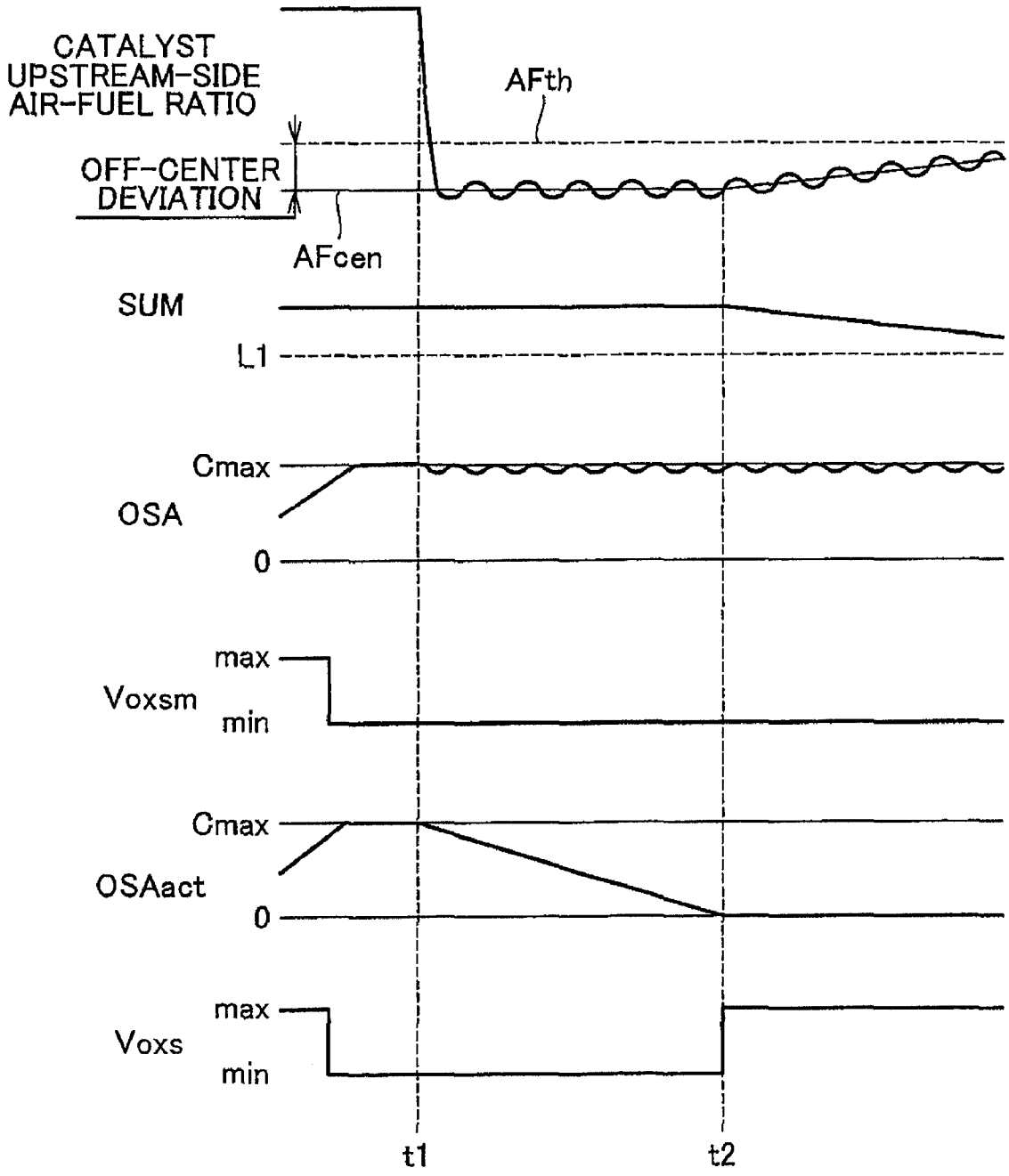
FIG. 7 is a timing chart illustrating an example case where the air-fuel ratio feedback control is executed when the control center air-fuel ratio is deviating from the stoichiometric air-fuel ratio.

FIG. 7 illustrates a state where the cut-off of fuel supply is continued for a while and ended at t1 and then the control center air-fuel ratio AFcen deviates to the rich side of the target air-fuel ratio abyfr (=the stoichiometric air-fuel ratio AFth) (Refer to "OFF-CENTER DEVIATION" in FIG. 7), that is, a state where the total sum SUM remains at a value larger than the target convergence value L1 and abyfr/(1+SUM) is smaller than AF1 (Refer to FIG. 2) by the amount corresponding to the above-stated deviation of the control center air-fuel ratio AFcen. Note that this deviation of the control center air-fuel ratio AFcen will be referred to as "off-center deviation" where necessary. In this state, the control center air-fuel ratio AFcen may be said to be the catalyst upstream-side air-fuel ratio corresponding to the state where the detected air-fuel ratio abyfs is equal to abyfr/(1+SUM).

In the state illustrated in FIG. 7, because air enters the first catalyst 53 during the fuel supply cut-off and the expression (8) is used instead of the expression (7) to calculate the oxygen storage amount OSA, at t1, the actual oxygen storage amount OSAact and the oxygen storage amount OSA are both equal to the maximum oxygen storage capacity Cmax and the oxygen sensor output value Voxs and the estimated output value Voxsm are both equal to min.

In response to the fuel supply cut-off being ended at t1, the main feedback control and the sub-feedback control, which have been described above, are started. Thus, after t1, as the upstream-side air-fuel ratio deviation DAF is controlled to zero, the catalyst upstream-side air-fuel ratio is controlled to the control center air-fuel ratio AFcen (i.e., an air-fuel ratio richer than the stoichiometric air-fuel ratio AFth).

As a result, exhaust gas having an air-fuel ratio richer than the stoichiometric air-fuel ratio AFth (exhaust gas containing much HC and CO) starts to enter the first catalyst 53, and therefore, after t1, the actual oxygen storage amount OSAact decreases from the maximum oxygen storage capacity Cmax toward zero. However, the oxygen sensor output value Voxs remains at min until the actual oxygen storage amount OSAact becomes zero at t2.

On the other hand, because the upstream-side air-fuel ratio deviation DAF remains at zero or at a value near zero after t1, the oxygen storage amount OSA remains at the maximum oxygen storage capacity Cmax or at a value near the maximum oxygen storage capacity Cmax after t1 (also after t2). That is, after t1 (also after t2), the estimated output value Voxsm also remains at min. As a result, during the time period from t1 to t2, the estimated output value Voxsm remains equal to the oxygen sensor output value Voxs and the output value deviation DVoxsm remains at zero, and therefore the total sum SUM remains constant at "the value larger than the target convergence value L1".

At t2, the exhaust gas containing much HC and CO starts to flow out of the first catalyst 53, and in response to this, the oxygen sensor output value Voxs is inverted from min to max. Thus, after t2, the estimated output value Voxsm is unequal to the output value Voxs, therefore the output value deviation DVoxsm remains negative. As a result, the total sum SUM, which has been larger than the target convergence value L1, decreases and thus approaches the target convergence value L1, whereby the control center air-fuel ratio AFcen approaches the stoichiometric air-fuel ratio AFth.

Thus, when the control center air-fuel ratio AFcen is not equal to the target air-fuel ratio abyfr (=the stoichiometric air-fuel ratio AFth), a difference arises between the estimated output value Voxsm and the oxygen sensor output value Voxs, however in response to that difference, the control center air-fuel ratio AFcen approaches to the target air-fuel ratio abyfr (=the stoichiometric air-fuel ratio AFth), whereby the error of the AF sensor 66 is properly compensated for.

Next, the actual operation of the air-fuel ratio control system of the first example embodiment will be described with reference to the flowcharts of FIG. 8 to FIG. 11. Note that, in the following description, "Map X(a1, a2 . . . )" represents a table for obtaining the value of X that uses a1, a2 . . . as arguments. In the case where the values of these arguments are the values detected by sensors, the present values are used.

Figure 8:
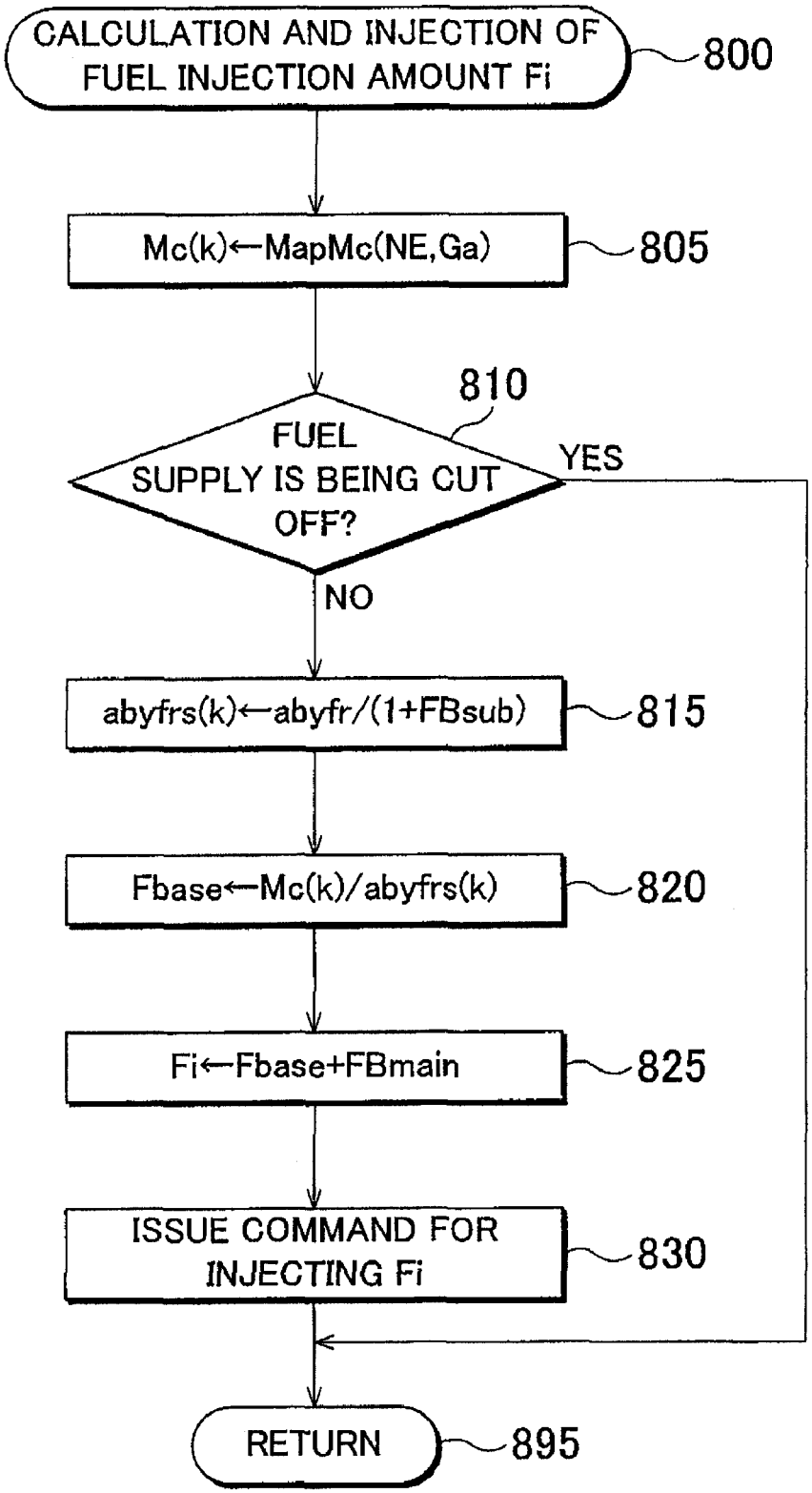
FIG. 8 is a flowchart illustrating a routine that is executed in the first example embodiment to calculate the required fuel injection amount and issue a corresponding fuel injection command.
Figure 9:
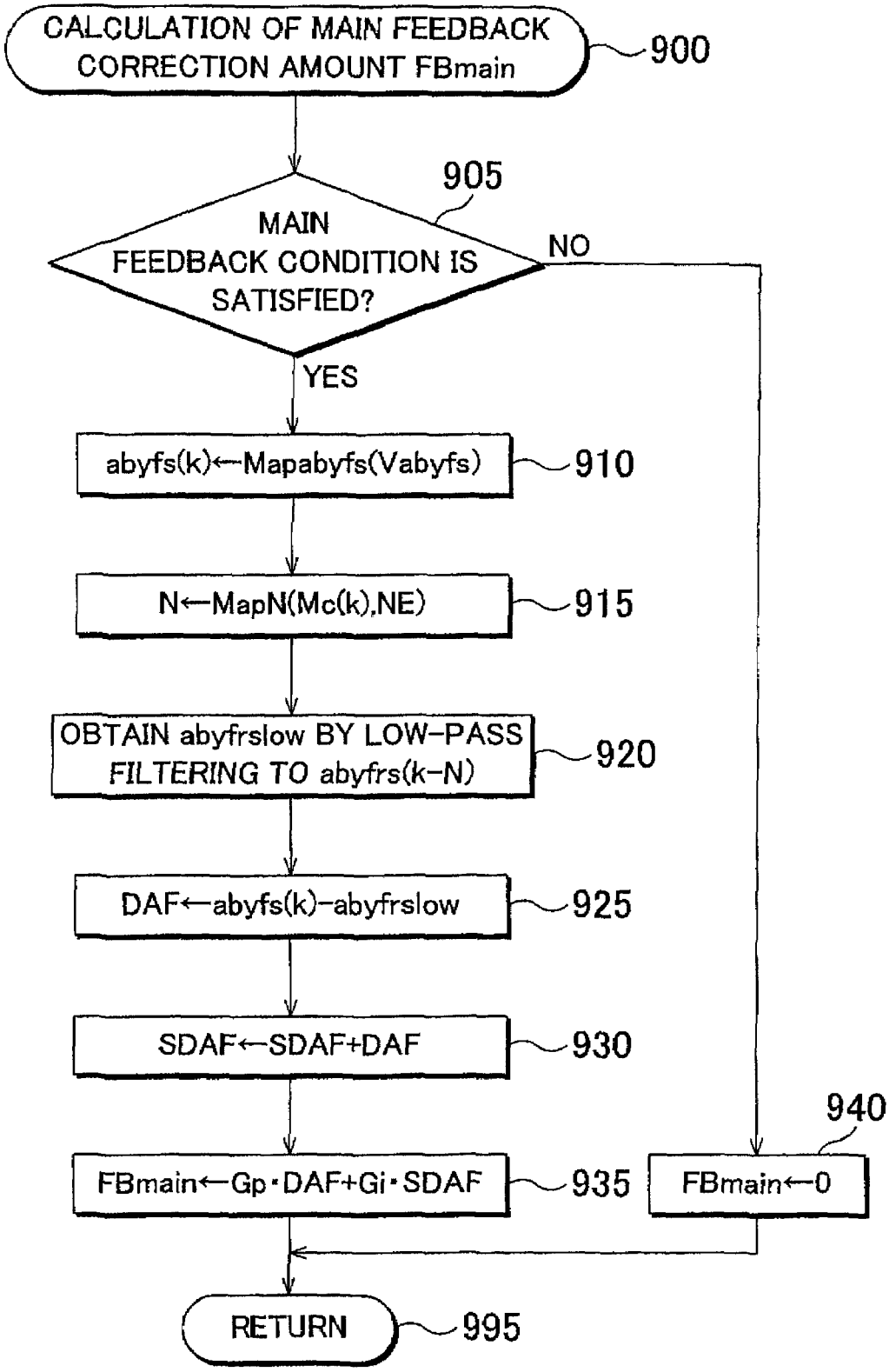
FIG. 9 is a flowchart illustrating a routine that is executed in the first example embodiment to calculate the main feedback correction amount.

The CPU 71 repeatedly executes the routine illustrated by the flowchart of FIG. 8 each time the crank angle of each cylinder reaches a predetermined crank angle before the intake stroke top dead center (e.g., BTDC 90° CA). This routine is executed to calculate the required fuel injection amount Fi and issue fuel injection commands.

When the crank angle of the cylinder that is about to undergo an intake stroke in the present cycle (will be referred to as "fuel injection cylinder" where necessary) reaches the predetermined crank angle, the CPU 71 starts the routine from step 800 and then proceeds to step 805. In step 805, the CPU 71 estimates, using the table MapMc (NE, Ga), the in-cylinder intake air amount Mc(k) that is the amount of intake air newly drawn into the fuel injection cylinder.

Then, the CPU 71 proceeds to step 810 and determines whether the fuel supply is presently cut off. If "YES", the CPU 71 proceeds to step 895 and finishes the present cycle of the routine at once. As such, fuel injection is not performed during the cut-off of fuel supply.

If the fuel supply is not presently cut off, the CPU 71 determines "NO" in step 810 and then proceeds to step 815. In step 815, the CPU 71 obtains the control target air-fuel ratio abyfrs(k) based on the target air-fuel ratio abyfr (=the stoichiometric air-fuel ratio AFth), the latest value of the sub-feedback correction amount FBsub that was determined by the routine described later (at the time when the last fuel injection was performed), and the foregoing expression (1). Then, in step 820, the CPU 71 obtains the basic fuel injection amount Fbase by dividing the in-cylinder intake air amount Mc(k) by the control target air-fuel ratio abyfrs(k).

Next, the CPU 71 proceeds to step 825 and calculates the required fuel injection amount Fi for the present cycle by adding the latest value of the main feedback correction amount FBmain obtained by the routine described later (at the time when the last fuel injection was performed) to the basic fuel injection amount Fbase.

Next, the CPU 71 proceeds to step 830 and issues a fuel injection command for injecting fuel of the required fuel injection amount Fi. Then, the CPU 71 proceeds to step 895 and finishes the present cycle of the routine. In this way, the main feedback control and the sub-feedback control are performed.

Next, the procedure for calculating the main feedback correction amount FBmain in the main feedback control will be described. The CPU 71 repeatedly executes the routine illustrated by the flowchart of FIG. 9 each time the fuel injection start time (injection command issuing time) for the corresponding fuel injection cylinder becomes.

In response to the arrival of the fuel injection start time, the CPU 71 starts the routine from step 900 and then proceeds to step 905. In step 905, the CPU 71 determines whether a main feedback condition is satisfied. The main feedback condition is regarded as being satisfied, for example, when the coolant temperature THW of the engine is equal to or higher than a first reference value, the AF sensor 66 is in a normal state (including an activated state), and the in-cylinder intake air amount Mc is equal to or smaller than a predetermined value.

Assuming that the main feedback condition is presently satisfied, the CPU 71 determines "YES" in step 905 and then proceeds to step 910. In step 910, the CPU 71 obtains the value of the detected air-fuel ratio abyfs(k) for the present cycle based on the table Mapabyfs (Vabyfs) (Refer to the solid curve in FIG. 2).

Next, the CPU 71 proceeds to step 915 and determines the stroke number N based on the table MapN(Mc(k), NE). Then, the CPU 71 proceeds to step 920 and obtains the low-pass-filter-processed control target air-fuel ratio abyfrslow by performing low-pass filtering to abyfrs(k-N), which is the value of the control target air-fuel ratio abyfrs used N strokes (N times of intake strokes) before the present time, using the time constant $\tau$.

Then, the CPU 71 proceeds to step 925 and calculates the upstream-side air-fuel ratio deviation DAF by subtracting the low-pass-filter-processed control target air-fuel ratio abyfrslow from the detected air-fuel ratio abyfs(k) as indicated by the foregoing expression (3).

Then, the CPU 71 proceeds to step 930 and updates the integral value SDAF of the upstream-side air-fuel ratio deviation DAF by adding the upstream-side air-fuel ratio deviation DAF obtained in step 925 to the integral value SDAF. Then, the CPU 71 proceeds to step 935 and calculates the main feedback correction amount FBmain as indicated by the foregoing expression (4), after which the CPU 71 proceeds to step 995 and finishes the present cycle of the routine.

As such, the main feedback correction amount FBmain is obtained. Then, the obtained main feedback correction amount FBmain is applied to the required fuel injection amount Fi in step 825 in FIG. 9. This is how the main feedback control is performed.

On the other hand, if the main feedback condition is not satisfied at the time of executing step 905, the CPU 71 determines "NO" in step 905 and then proceeds to step 940. In step 940, the CPU 71 sets the main feedback correction amount FBmain to zero, after which the CPU 71 proceeds to step 995 and finishes the present cycle of the routine. As such, when the main feedback condition is not satisfied, the main feedback correction amount FBmain is set to zero and therefore the air-fuel ratio feedback control based on the main feedback control is not performed.

Next, the procedure for calculating the sub-feedback correction amount FBsub during the sub-feedback control will be described. The CPU 71 repeatedly executes the routine illustrated by the flowchart of the FIG. 10 each time the fuel injection start time (fuel injection command issuing time) for the fuel injection cylinder becomes.

In response to the arrival of the fuel injection start time for the fuel injection cylinder, the CPU 71 starts the routine from step 1000 and proceeds to step 1005. In step 1005, the CPU 71 determines whether a sub-feedback condition is presently satisfied. The sub-feedback condition is regarded as being satisfied when the foregoing main feedback condition is satisfied and the coolant temperature THW of the engine is equal to or higher than a second reference value that is higher than the first reference value.

Assuming that the sub-feedback condition is presently satisfied, the CPU 71 determines "YES" in step 1005 and then proceeds to step 1010. In step 1010, the CPU 71 calculates the downstream-side deviation DVoxs by subtracting the present output value Voxs of the oxygen sensor 67 from the downstream-side target value Voxsref as indicated by the foregoing expression (5). Then, in step 1015, the CPU 71 calculates the proportion-derivation correction amount FBsub1 by performing a proportional derivative processing to the downstream-side deviation DVoxs.

Then, the CPU 71 proceeds to step 1020 and updates the oxygen storage amount OSA based on the latest value of the required fuel injection amount Fi obtained in step 825, the latest value of the upstream-side air-fuel ratio deviation DAF obtained in step 925, and the foregoing expression (7) (or the foregoing expression (8)). Then, the CPU 71 proceeds to step 1025 and updates the estimated output value Voxsm based on the updated oxygen storage amount OSA and the output characteristic illustrated in FIG. 5.

Figure 6:
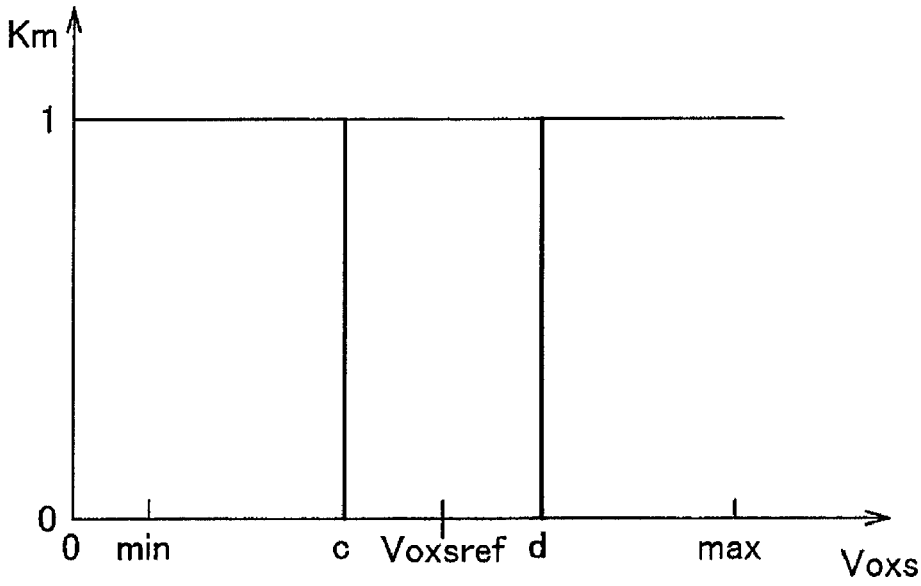
FIG. 6 is a graph illustrating the relationship between a coefficient used in calculating the output value deviation of the first example embodiment and the output value of the oxygen sensor.

Then, the CPU 71 proceeds to step 1030 and obtains the output value deviation DVoxsm based on the estimated output value Voxsm, the oxygen sensor output value Voxs, a coefficient Km determined by the table illustrated in FIG. 6, and the foregoing expression (9).

Then, the CPU 71 proceeds to step 1035 and updates the integral value of deviation SDVoxs by adding the downstream-side deviation DVoxsm obtained in step 1030 to the present integral value of deviation SDVoxsm. Then, in step 1040, the CPU 71 calculates the integral term FBsub2 based on the integral value of deviation SDVoxsm updated as above and the foregoing expression (10). Then, in step 1045, the CPU 71 calculates the total sum SUM by summing the integral term FBsub2 and the learning value Learn for the integral term FBsub2, which is set and updated in the routine described later.

Then, the CPU 71 proceeds to step 1050 and calculates the sub-feedback correction amount FBsub based on the proportion-derivation correction amount FBsub1 obtained in step 1015, the total sum SUM obtained in step 1045, and the foregoing expression (11), after which the CPU 71 proceeds to step 1095 and finishes the present cycle of the routine.

As such, the sub-feedback correction amount FBsub is obtained. Then, the sub-feedback correction amount FBsub is applied to the control target air-fuel ratio abyfrs(k) in step 815 of FIG. 8, and this control target air-fuel ratio abyfrs(k) is then used in the routine shown in FIG. 9 (i.e., the main feedback control). This is how the sub-feedback control is performed.

On the other hand, if it is determined in step 1005 that the sub-feedback control is not satisfied, the CPU 71 determines "NO" in step 1005 and then proceeds to step 1055. In step 1055, the CPU 71 sets the proportion-derivation correction amount FBsub1 and the integral term FBsub2 to zero and executes the processes of step 1045 and step 1050. As such, when the sub-feedback condition is not satisfied, the error of the AF sensor 66 is compensated for by maintaining the sub-feedback correction amount FBsub equal to the learning value Learn, and the air-fuel ratio feedback control based on the sub-feedback control is not performed.

Next, the procedure for updating the learning value Learn for the integral term FBsub2 will be described. The CPU 71 repeatedly executes the routine illustrated by the flowchart of FIG. 11 each time the fuel injection start time (injection command issuing time) for the fuel injection cylinder becomes.

In response to the arrival of the fuel injection start time, the CPU 71 starts the routine from step 1100 and proceeds to step 1105. In step 1105, the CPU 71 determines whether the sub-feedback condition is satisfied as in step 1005.

If the CPU 71 determines "NO" in step 1105, the CPU 71 proceeds to step 1195 and finishes the present cycle of the routine at once. In this case, the learning value Learn is not updated. On the other hand, if the CPU 71 determines "YES" in step 1105, the CPU 71 then proceeds to step 1110 and obtains a smoothed integral term FBsub2low by performing low-pass filtering to the integral term FBsub2 obtained in step 1040.

Then, the CPU 71 proceeds to step 1115 and determines whether the time for updating the learning value Learn has become. If "NO" in step 1115, the CPU 71 proceeds to step 1195 and finishes the present cycle of the routine at once. In this case, the learning value Learn is not updated. In the first example embodiment, the time for updating the learning value Learn becomes each time fuel injection has been performed for a predetermined number of times.

Assuming that the time for updating the learning value Learn has just become, the CPU 71 determines "YES" in step 1115 and then proceeds to step 1120. In step 1120, the CPU 71 sets an updating value DLearn for updating the learning value Learn to the present value of the smoothed integral term FBsub2low that has been updated in step 1100.

Then, the CPU 71 proceeds to step 1125 and calculates the new value of the learning value Learn (updates the learning value Learn) by adding the updating value DLearn obtained in step 1120 to the learning value Learn that is presently recorded in the 74.

Then, the CPU 71 proceeds to step 1130 and subtracts the updating value DLearn from the present value of the integral term FBsub2. Then, in step 1135, the CPU 71 corrects the integral value of deviation SDVoxsm to FBsub2/Ki, whereby the integral value of deviation SDVoxsm is made a value corresponding to the integral term FBsub2 from which the updating value DLearn has been subtracted. Then, the CPU 71 proceeds to step 1140 and resets the smoothed integral term FBsub2low to zero, after which the CPU 71 proceeds to step 1195 and finishes the present cycle of the routine.

As such, each time the updating time becomes, steady components of the integral term FBsub2 (=the smoothed integral term FBsub2low) are transferred to the learning value Learn, whereby the learning value Learn is updated.

As such, according to the air-fuel ratio control system of the first example embodiment of the invention, the sub-feedback correction amount FBsub is obtained by the sub-feedback control based on the oxygen sensor output value Voxs and the target air-fuel ratio is corrected based on the sub-feedback correction amount FBsub (the control target air-fuel ratio abyfrs is calculated), and the catalyst upstream-side air-fuel ratio is controlled by the main feedback control based on the output value Vabyfs of the AF sensor 66 upstream of the catalyst such that the difference between the detected air-fuel ratio abyfs obtained from the output value Vabyfs of the AF sensor 66 and the control target air-fuel ratio abyfrs (i.e., the upstream-side air-fuel ratio deviation DAF) is zeroed.

When calculating the sub-feedback correction amount FBsub, the difference between the estimated output value Voxsm and the oxygen sensor output value Voxs (the output value deviation DVoxsm) is calculated by using the catalyst model A13 that calculates the oxygen storage amount OSA of the first catalyst 53 based on the upstream-side air-fuel ratio deviation DAF and the oxygen sensor model A14 that calculates the estimated output value Voxsm of the output value Voxs based on the estimated oxygen storage amount OSA. Further, the sub-feedback correction amount FBsub is calculated as the sum of the value obtained by performing a proportional and derivative processing to the difference between the downstream-side target value Voxsref corresponding to the target air-fuel ratio and the oxygen sensor output value Voxs (i.e., the downstream-side deviation DVoxs) and the value obtained by performing an integral processing to the output value deviation DVoxsm (i.e., the total sum SUM).

Thus, by calculating the integral term of the sub-feedback control (=the total sum SUM) by performing an integral processing to the output value deviation DVoxsm instead of the downstream-side deviation DVoxs, the following advantages and effects may be obtained. That is, when the control center air-fuel ratio AFcen is equal to the target air-fuel ratio abyfr (=the stoichiometric air-fuel ratio AFth) (when the total sum SUM is equal to the value corresponding to the magnitude of the error of the AF sensor 66 (target convergence value)), even if an external interference, such as the cut-off of fuel supply, occurs to the air-fuel ratio control, the estimated output value Voxsm continues to remain at zero or at a value near zero and therefore the total sum SUM does not (is unlikely to) deviate from the target convergence value L1. Therefore, even if an external interference, such as the cut-off of fuel supply, occurs to the air-fuel ratio control, the control center air-fuel ratio AFcen does not deviate from the target air-fuel ratio abyfr (=the stoichiometric air-fuel ratio AFth), whereby the error of the AF sensor 66 may be properly compensated for.

Further, when the control center air-fuel ratio AFcen is not equal to the upstream-side target air-fuel ratio abyfr (=the stoichiometric air-fuel ratio AFth) (when the total sum SUM is deviating from the target convergence value L1), the downstream-side deviation DVoxs is set to a value that makes the total sum SUM approach the target convergence value L1, whereby the total sum SUM approaches the target convergence value L1. As a result, the control center air-fuel ratio AFcen approaches the upstream-side target air-fuel ratio abyfr (=the stoichiometric air-fuel ratio AFth), whereby the error of the AF sensor 66 is properly compensated for.

Further, when the oxygen sensor output value Voxs is in a predetermined range (from c to d) including the downstream-side target value Voxsref, the output value deviation DVoxsm is forcibly zeroed (Refer to FIG. 6 and the expression (9)), and therefore the total sum SUM is not updated. As such, when the control center air-fuel ratio AFcen is close to the target air-fuel ratio abyfr (=the stoichiometric air-fuel ratio AFth) (when the total sum SUM is close to the target convergence value L1), the total sum SUM is prevented from deviating from the target convergence value L1, and therefore the control center air-fuel ratio AFcen does not deviate from the target air-fuel ratio abyfr (=the stoichiometric air-fuel ratio AFth).

Figure 12:
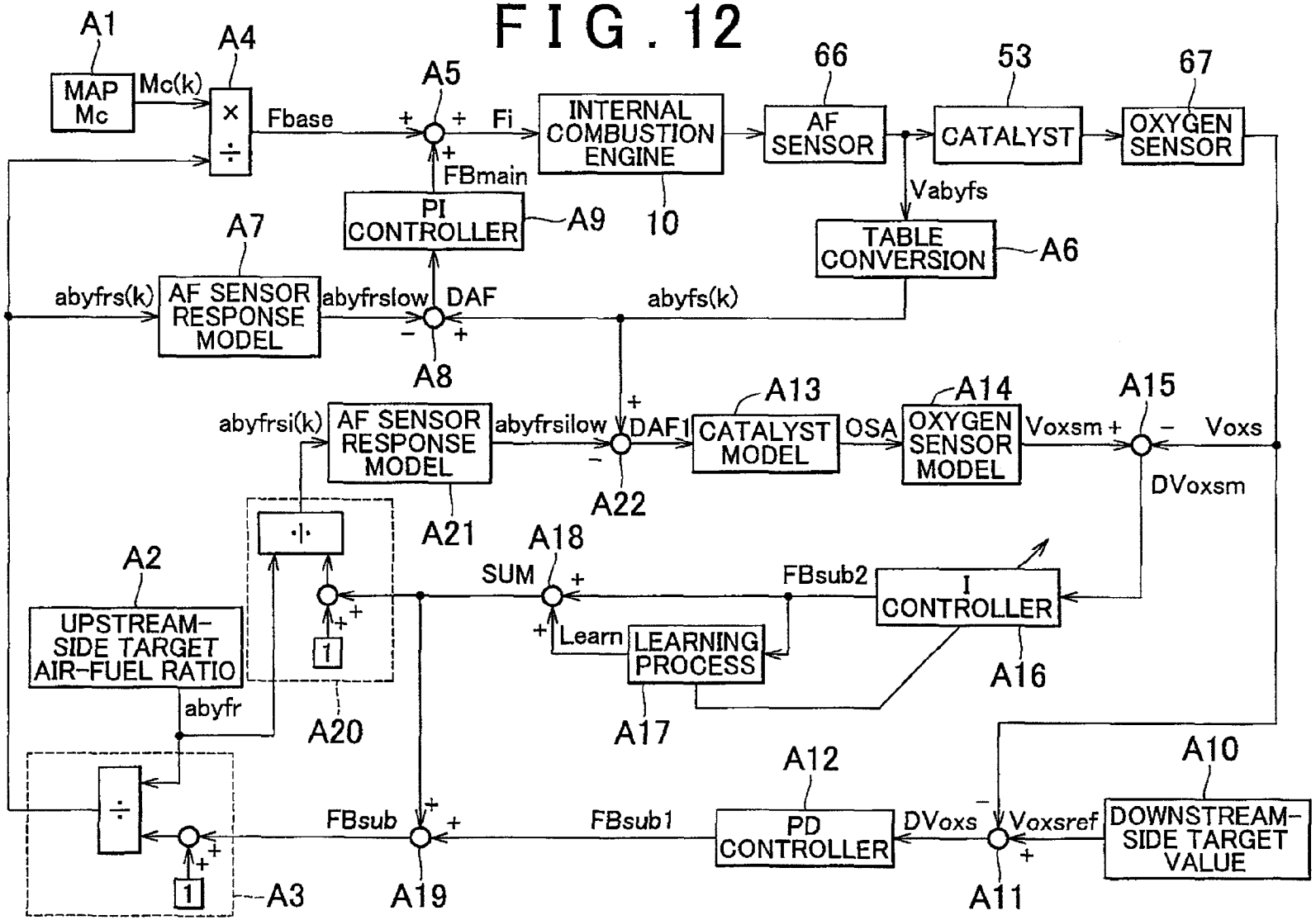
FIG. 12 is a function block diagram illustrating function blocks used when the air-fuel ratio control system of the second example embodiment executes the air-fuel ratio feedback control.

Next, an air-fuel ratio control system according to the second example embodiment of the invention will be described. FIG. 12 is a function block diagram indicating the function blocks of the air-fuel ratio control system of the second example embodiment. The air-fuel ratio control system of the second example embodiment is different from the air-fuel ratio control system of the first example embodiment in the following point. In the first example embodiment, the difference between the target air-fuel ratio corrected by the sub-feedback correction amount FBsub and the detected air-fuel ratio abyfs of the AF sensor 66 (the upstream-side air-fuel ratio deviation DAF) is input to the catalyst model A13. In the second example embodiment, on the other hand, the difference between the target air-fuel ratio corrected by the total sum SUM and the detected air-fuel ratio abyfs of the AF sensor 66 (an integral correction air-fuel ratio deviation DAF1) is input to the catalyst model A13.

More specifically, in FIG. 12, function blocks A20 to A22 are added to the function blocks shown in FIG. 4. Integration correction target air-fuel ratio setting means A20 sets an integration correction target abyfrsi(k) based on the target air-fuel ratio abyfr and the total sum SUM as indicated by the expression (12) shown below.

$$abyfrsi(k)=abyfr/(1+\mathrm{SUM}) \quad (12)$$

As is evident from the expression (12), the integration correction target air-fuel ratio abyfrsi(k) is determined as an air-fuel radio that is higher or lower than the target air-fuel ratio abyfr by the amount corresponding to the total sum SUM. The integration correction target air-fuel ratio abyfrsi is recorded in the RAM 73 by being identified as corresponding to the intake stroke of each cylinder.

An AF sensor response model A21 corresponds to the AF sensor response model A7. That is, the AF sensor response model A21 outputs a low-pass-filter-processed integration correction target air-fuel ratio abyfrsilow that is obtained by performing low-pass filtering to abyfrsi (k-N), which is the value of the integration correction control target air-fuel ratio abyfrsi used N strokes (N times of intake strokes) before the present time, using the time constant $\tau$.

Integration correction air-fuel ratio deviation calculating means A22 calculates the value of the integral correction air-fuel ratio deviation DAF1 obtained N strokes before the present time (corresponding to "second deviation") by subtracting the integration correction target air-fuel ratio abyfrsilow from the detected air-fuel ratio abyfs(k) obtained in the present cycle, as indicated by the expression (13) shown below.

$$DAF1=abyfs(k)-abyfrsi\mathrm{low} \quad (13)$$

The catalyst model A13 reads in the integral correction air-fuel ratio deviation DAF1 obtained as described above and estimates (updates) the oxygen storage amount OSA as indicated by the expression (14) corresponding to the expression (7).

$$OSA=\Sigma(0.23\times DAF1\times Fi)(0\leqq OSA\leqq C\mathrm{max}) \quad (14)$$

Figure 13:
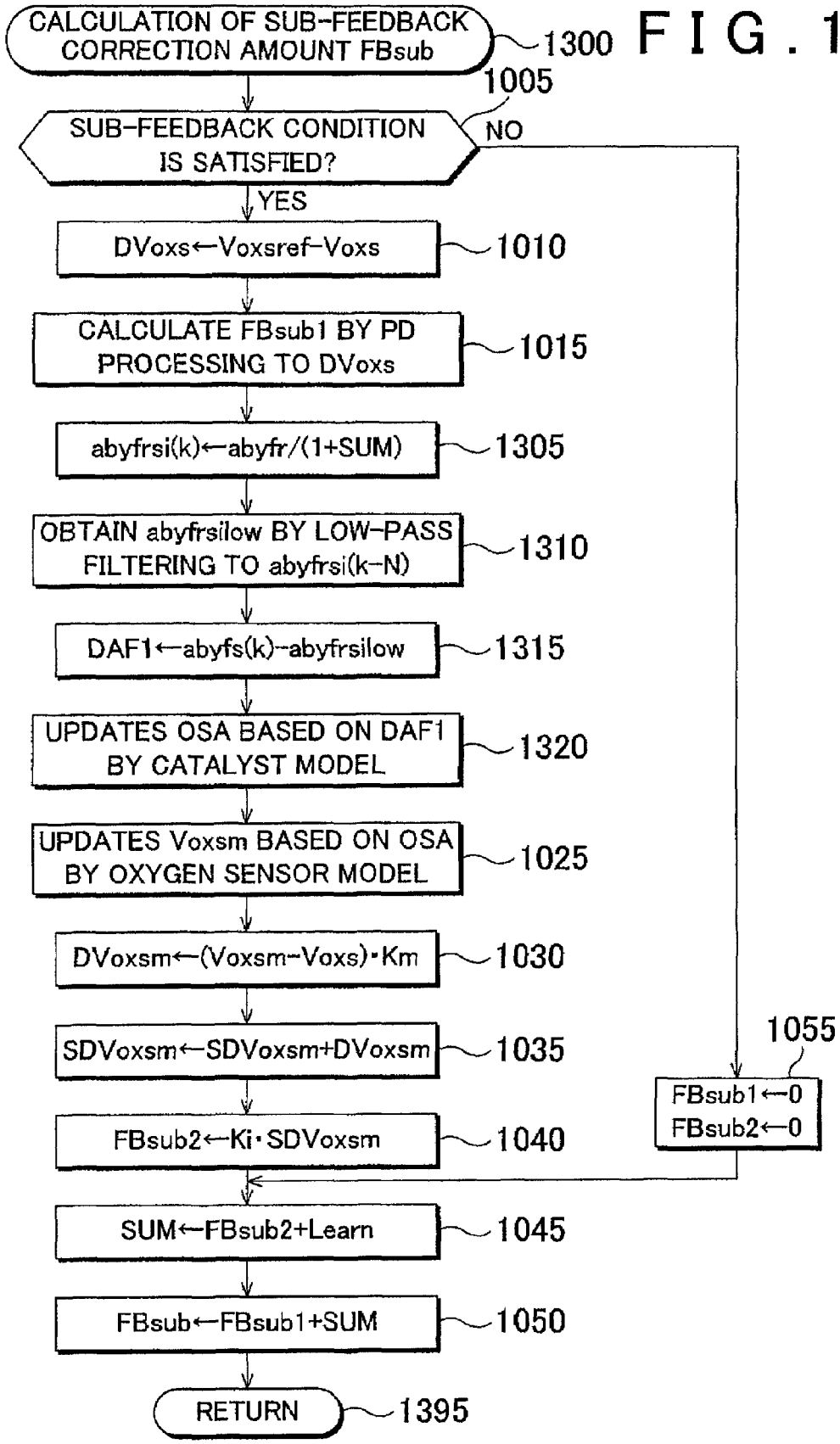
FIG. 13 is a flowchart illustrating a routine that is executed in the second example embodiment to calculate the sub-feedback correction amount.

FIG. 13 is a flowchart illustrating a routine that the CPU 71 of the second example embodiment executes to calculate the sub-feedback correction amount FBsub. The routine of FIG. 13 is different from the routine of FIG. 10 only in that step 1305 corresponding to the integration correction target air-fuel ratio setting means A20, and step 1310 corresponding to the AF sensor response model A21, and step 1315 corresponding to the integration correction air-fuel ratio deviation calculating means A22 have been added and step 1020 has been replaced by step 1320 ("DAF" has been replaced by "DAF1"). Detail on the routine of FIG. 13 will not be described.

Hereinafter, the effects and advantages obtained by the air-fuel ratio control system of the second example embodiment will be described. Now, consideration is made of the case where the component of the sub-feedback correction amount FBsub associated with the downstream-side deviation DVoxs (i.e., the proportion-derivation correction amount FBsub1) becomes large and therefore the catalyst upstream-side air-fuel ratio temporarily deviates from the target air-fuel ratio abyfr (=the stoichiometric air-fuel ratio AFth) (sharply changes) due to an external interference occurring to the oxygen sensor output value Voxs when the upstream-side air-fuel ratio deviation DAF is being controlled to zero by the main feedback control while the control center air-fuel ratio AFcen is equal to the target air-fuel ratio abyfr (=the stoichiometric air-fuel ratio AFth).

In this case, the upstream-side air-fuel ratio deviation DAF continues to remain at a value near zero. On the other hand, the integral correction air-fuel ratio deviation DAF1 becomes larger or smaller than the upstream-side air-fuel ratio deviation DAF by the amount corresponding to the proportion-derivation correction amount FBsub1. Therefore, even when the catalyst upstream-side air-fuel ratio has temporarily deviated from the target air-fuel ratio abyfr (=the stoichiometric air-fuel ratio AFth), 0.23×DAF1×Fi, which represents the excess and deficiency of oxygen in the exhaust gas entering the first catalyst 53 per injection of fuel and is used by the catalyst model A13 (i.e., in the expression (14)), becomes equal to the excess and deficiency of oxygen in the exhaust gas actually entering the first catalyst 53.

As such, even if an external interference, such as the cut-off of fuel supply, occurs to the output value Voxs of the oxygen sensor 67, the variation of the oxygen storage amount OSA that is estimated by the catalyst model A13 may be made to coincide with the variation of the actual oxygen storage amount OSAact of the first catalyst 53 that changes in response to the external interference, and therefore the variation of the estimated output value Voxsm estimated by the oxygen sensor model A14 may be made to coincide with the variation of the actual output value Voxs of the oxygen sensor 67.

On the other hand, in the first example embodiment, even when an external interference has occurred to the oxygen sensor output value Voxs, the upstream-side air-fuel ratio deviation DAF still remains close to zero and thus the oxygen storage amount OSA estimated by the catalyst model A13 remains substantially constant. That is, the variation of the oxygen storage amount OSA that is estimated by the catalyst model A13 does not coincide with the variation of the actual oxygen storage amount OSAact of the first catalyst 53. In this case, therefore, it is highly likely that the variation of the estimated output value Voxsm estimated by the oxygen sensor model A14 does not coincide with the variation of the actual output value Voxs of the oxygen sensor 67. For this reason, in the second example embodiment, it is possible to make the variation of the estimated output value Voxsm coincide with the variation of the actual output value Voxs of the oxygen sensor 67 precisely as compared to in the first example embodiment.

The invention is not limited to the foregoing example embodiments, but it is intended to cover various modifications within the scope of the invention. For example, while the basic fuel injection amount Fbase is set to the value obtained by dividing the in-cylinder intake air amount Mc by the control target air-fuel ratio abyfrs in the foregoing example embodiments, the basic fuel injection amount Fbase may alternatively be set to the value obtained by dividing the in-cylinder intake air amount Mc by the target air-fuel ratio abyfr.

Further, in the foregoing example embodiments, the control target air-fuel ratio abyfrs is set by correcting the target air-fuel ratio abyfr (=the stoichiometric air-fuel ratio AFth) based on the sub-feedback correction amount FBsub and the main feedback control is executed such that the detected air-fuel ratio abyfs equals the control target air-fuel ratio abyfrs. However, alternatively, the detected air-fuel ratio abyfs (or the output value Vabyfs of the AF sensor 66) may be corrected based on the sub-feedback correction amount FBsub, and the main feedback control may be executed such that the corrected value of the detected air-fuel ratio abyfs (or the output value Vabyfs of the AF sensor 66) equals the target air-fuel ratio abyfr (=the stoichiometric air-fuel ratio AFth).

Further, the simple catalyst model A13 that is expressed by the expression (7) or by the expression (14) is used in the foregoing example embodiments, a more complicated catalyst model may alternatively be used in order to improve the accuracy in estimating the oxygen storage amount OSA. Examples of such a complicated catalyst model are described in Japanese Patent Application Publication No. 2004-36475 (JP-A-2004-36475) and Japanese Patent Application Publication No. 2004-225618 (JP-A-2004-225618).

Figure 10:
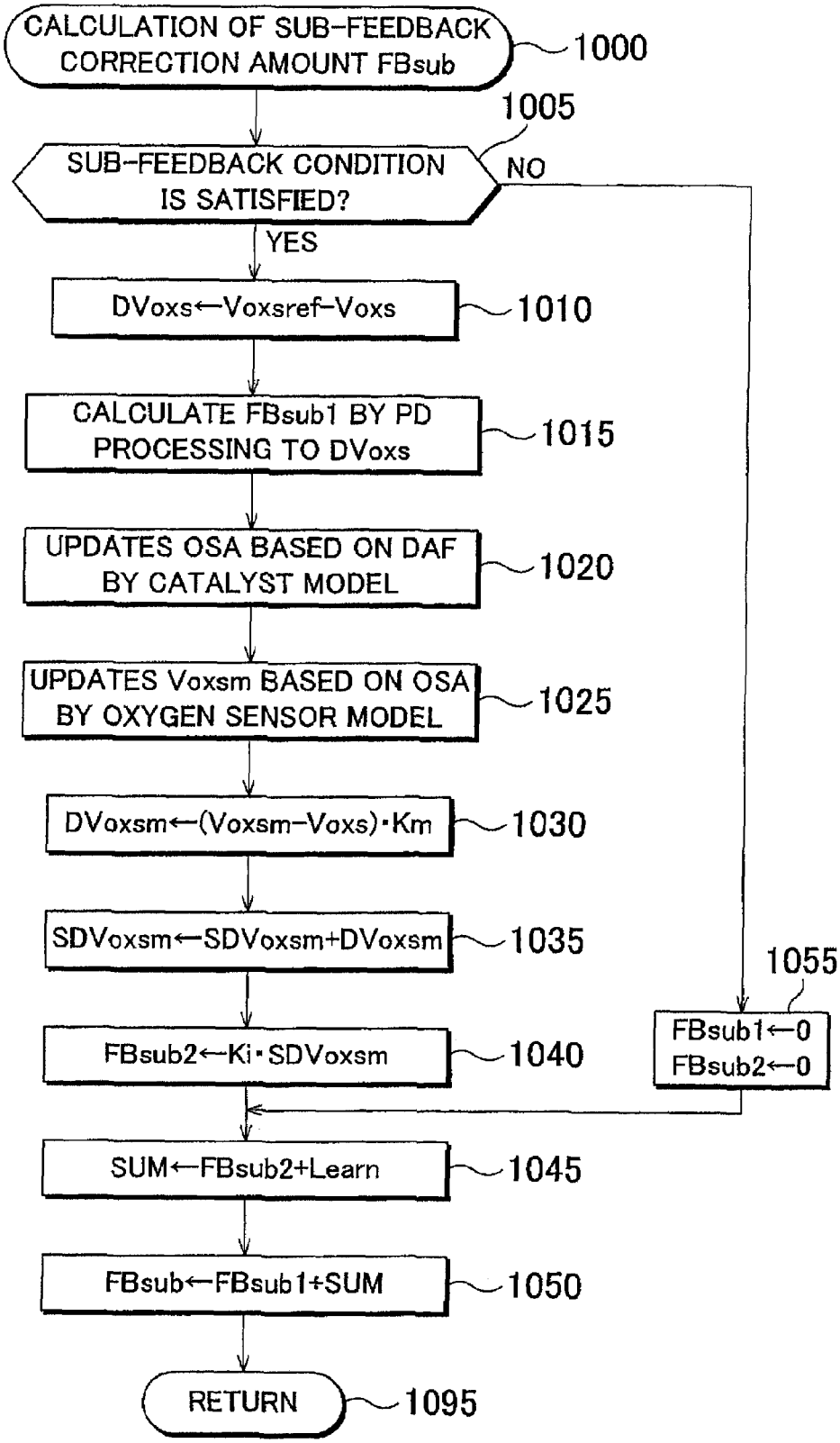
FIG. 10 is a flowchart illustrating a routine that is executed in the first example embodiment to calculate the sub-feedback correction amount.
Figure 11:
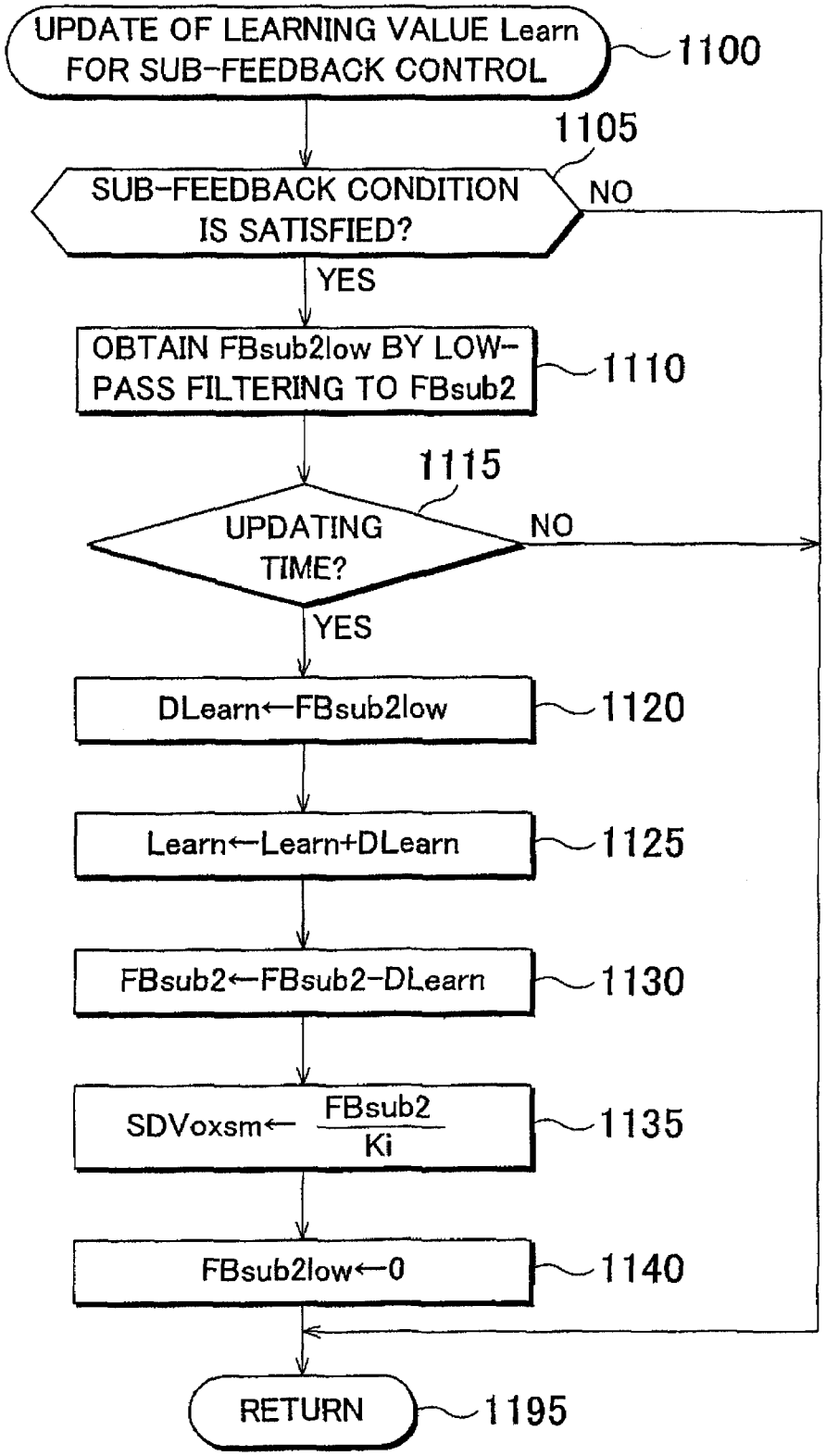
FIG. 11 is a flowchart illustrating a routine that is executed in the first example embodiment to update a learning value.
Figure 14:
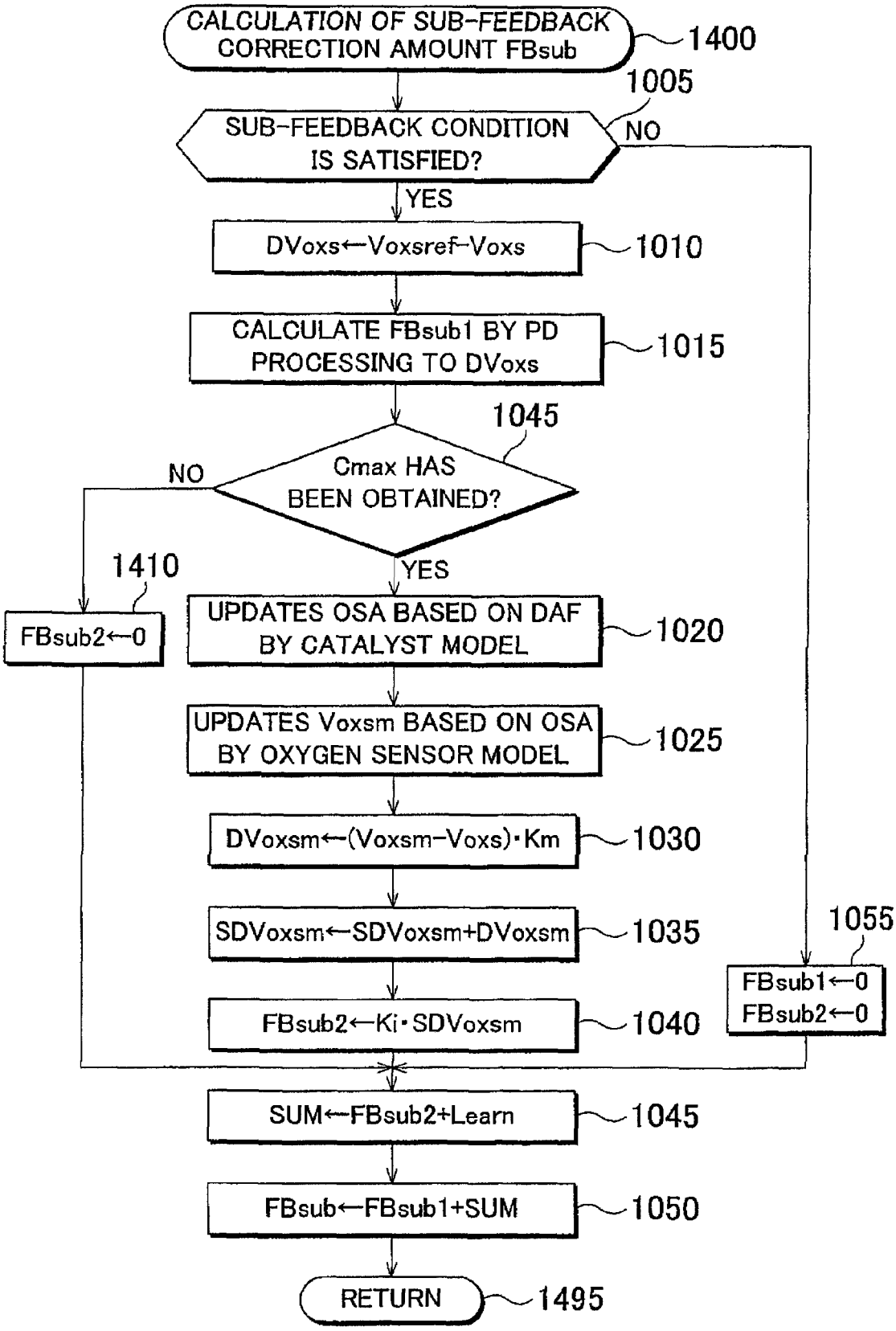
FIG. 14 is a flowchart illustrating a routine that is executed in a modification example of the first example embodiment to calculate the sub-feedback correction amount.

Further, although the foregoing example embodiments assume that the maximum oxygen storage capacity Cmax of the first catalyst 53 has already been determined, if the state where the maximum oxygen storage capacity Cmax has not yet been determined is also taken into consideration, the sub-feedback correction amount FBsub is preferably calculated using the routine of FIG. 14 instead of the routine of FIG. 10.

The routine of FIG. 14 is different from the routine of FIG. 10 only in that step 1405 and step 1410 have been added. Detail on the routine of FIG. 14 will not be described. When the sub-feedback correction amount FBsub is calculated using the routine of FIG. 14, if the maximum oxygen storage capacity Cmax has not yet been determined, the integral term FBsub2 is maintained at zero and therefore the total sum SUM is not updated. This eliminates the possibility that the total sum SUM be updated based on an inaccurately obtained value of the oxygen storage amount OSA, that is, an inaccurately obtained value of the estimated output value Voxsm.

Further, if the state where the maximum oxygen storage capacity Cmax has not yet been determined is also taken into consideration, the sub-feedback correction amount FBsub may be calculated using the routine of the 15 instead of the routine of FIG. 10.

Figure 15:
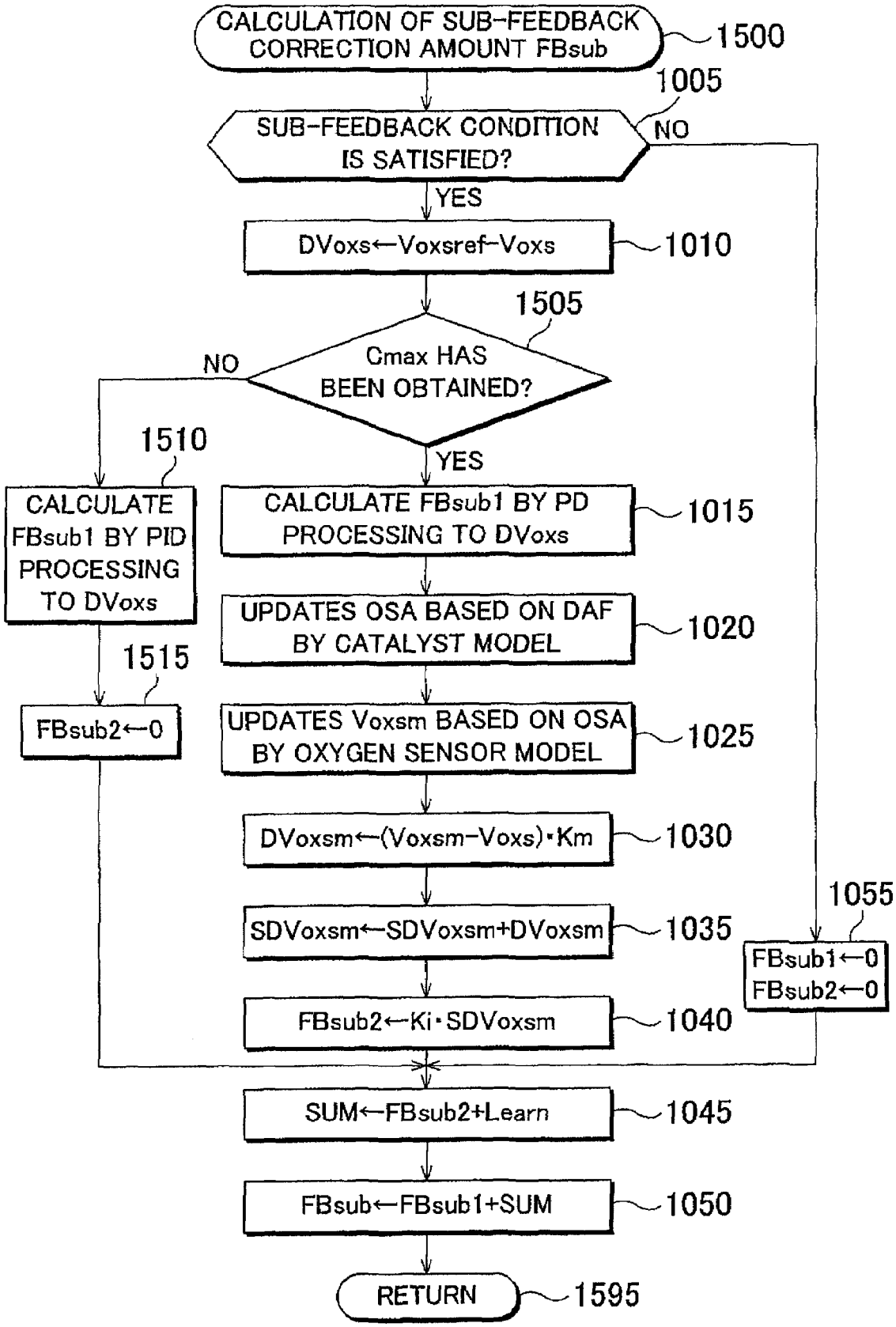
FIG. 15 is a flowchart illustrating a routine that is executed in another modification example of the first example embodiment to calculate the sub-feedback correction amount.

The routine of FIG. 15 is different from the routine of FIG. 10 only in that step 1505, step 1510, and step 1515 have been added. Detail of the routine of FIG. 15 will not be described. In the case where the sub-feedback correction amount FBsub is calculated using the routine of FIG. 15, when the maximum oxygen storage capacity Cmax has not yet been determined, the integral term FBsub2 is maintained at zero, and the proportion-derivation correction amount FBsub1 is calculated by performing a proportional integral derivative processing to the downstream-side deviation DVoxs. Therefore, when the maximum oxygen storage capacity Cmax has not yet been determined, the sub-feedback correction amount FBsub including an integral term is calculated as in the case of the system described in JP-A-2005-113729. Therefore, the error of the intake/exhaust system may be compensated for at least as effectively as by the system described in JP-A-2005-113729.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

What is claimed is:

1. An air-fuel ratio control system for an internal combustion engine, which is applied to an internal combustion engine that includes:

a catalyst that is provided in an exhaust passage of the internal combustion engine and that has a property of storing oxygen;

an air-fuel ratio sensor that is provided upstream of the catalyst in the exhaust passage and that outputs a value corresponding to the air-fuel ratio of exhaust gas entering the catalyst; and an electromotive force type oxygen concentration sensor that is provided downstream of the catalyst in the exhaust passage and that outputs a value corresponding to the air-fuel ratio of exhaust gas flowing out of the catalyst, wherein the air-fuel ratio control system comprises:

output value estimation means for estimating the output value of the oxygen concentration sensor using a catalyst model that estimates an oxygen storage amount of the catalyst, and an oxygen concentration sensor model that estimates the output value of the oxygen concentration sensor based on the estimated oxygen storage amount;

integral value calculation means for calculating an integral value of deviation which is updated by integrating a difference between an actual output value of the oxygen concentration sensor and the estimated output value;

correction value calculation means for calculating, based on at least the integral value of deviation, a feedback correction value for correcting a value corresponding to the output value of the air-fuel ratio sensor and/or a target air-fuel ratio; and air-fuel ratio control means for performing a control so that the air-fuel ratio of the exhaust gas entering the catalyst is equal to the target air-fuel ratio by controlling a first deviation to be zeros, the first deviation being obtained by correcting a difference between a detected air-fuel ratio detected based on the output value of the air-fuel ratio sensor and the target air-fuel ratio, using the feedback correction value.

2. The air-fuel ratio control system for the internal combustion engine according to claim 1, wherein the output value estimation means estimates the estimated output value by inputting, to the catalyst model, a value of the excess or deficiency of oxygen in exhaust gas entering the catalyst, the excess or deficiency of oxygen in exhaust gas entering the catalyst being obtained from the first deviation.

3. The air-fuel ratio control system for the internal combustion engine according to claim 1, wherein the correction value calculation means calculates the feedback correction value based on the integral value of deviation and a difference between the actual output value of the oxygen concentration sensor and a target value of the output value, which is corresponding to the target air-fuel ratio.

4. The air-fuel ratio control system for the internal combustion engine according to claim 1, wherein the correction value calculation means calculates the feedback correction value based on the integral value of deviation and a difference between the actual output value of the oxygen concentration sensor and a target value of the output value, which is corresponding to the target air-fuel ratio; and the output value estimation means estimates the output value by inputting, to the catalyst model, a value of the excess or deficiency of oxygen in exhaust gas entering the catalyst, the excess or deficiency of oxygen in exhaust gas entering the catalyst being obtained from a second deviation that is obtained by correcting the difference between the detected air-fuel ratio and the target air-fuel ratio using the integral value of deviation.

5. The air-fuel ratio control system for the internal combustion engine according to claim 1, wherein the oxygen concentration sensor model, which is used by the output value estimation means, sets the estimated output value to a value indicating a lean air-fuel ratio or a value indicating a rich air-fuel ratio such that the estimated output value is inverted from the value indicating a rich air-fuel ratio to the value indicating a lean air-fuel ratio when the oxygen storage amount has exceeded a first reference value while the estimated output value is inverted from the value indicating a lean air-fuel ratio to the value indicating a rich air-fuel ratio when the oxygen storage amount has fallen below a second reference value that is smaller than the first reference value.

6. The air-fuel ratio control system for the internal combustion engine according to claim 5, wherein the integral value calculation means does not update the integral value of deviation when the actual output value of the oxygen concentration sensor is within a predetermined range including a target value of the output value, which is corresponding to the target air-fuel ratio.

7. The air-fuel ratio control system for the internal combustion engine according to claim 1, wherein the catalyst model, which is used by the output value estimation means, estimates the oxygen storage amount of the catalyst using a maximum oxygen storage capacity of the catalyst, which is a maximum amount of oxygen that can be stored in the catalyst; and the integral value calculation means does not update the integral value of deviation before the maximum oxygen storage capacity is determined.

8. The air-fuel ratio control system for the internal combustion engine according to claim 7, wherein before the maximum oxygen concentration capacity is determined, the correction value calculation means calculates the feedback correction value, based on an integral value that is updated by integrating a difference between the actual output value of the oxygen concentration sensor and a target value of the output value, which is corresponding to the target air-fuel ratio, instead of the integral value of deviation.

9. An air-fuel ratio control method for an internal combustion engine, which is applied to an internal combustion engine that includes a catalyst that is provided in an exhaust passage of the internal combustion engine and that has a property of storing oxygen; and air-fuel ratio sensor that is provided upstream of the catalyst in the exhaust passage and that outputs a value corresponding to an air-fuel ratio of exhaust gas entering the catalyst; and an electromotive force type oxygen concentration sensor that is provided downstream of the catalyst in the exhaust passage and that outputs a value corresponding to the air-fuel ratio of exhaust gas flowing out of the catalyst, wherein the air-fuel ratio control method comprising:

estimating an output value of an oxygen concentration sensor using a catalyst model that estimates an oxygen storage amount of the catalyst, and an oxygen concentration sensor model that estimates the output value of the oxygen concentration sensor based on the estimated oxygen storage amount;

calculating an integral value of deviation which is updated by integrating a difference between an actual output value of the oxygen concentration sensor and the estimated output value;

calculating, based on at least the integral value of deviation, a feedback correction value for correcting, a value corresponding to the output value of the air-fuel ratio sensor and/or a target air-fuel ratio; and performing a control so that the air-fuel ratio of the exhaust gas entering the catalyst is equal to the target air-fuel ratio by controlling a first deviation to be zero, the first deviation being obtained by correcting a difference between a detected air-fuel ratio detected based on the output value of the air-fuel ratio sensor and the target air-fuel ratio, using the feedback correction value.

10. An air-fuel ratio control system for an internal combustion engine, which is applied to an internal combustion engine that includes a catalyst that is provided in an exhaust passage of the internal combustion engine and that has a property of storing oxygen;

an air-fuel ratio sensor that is provided upstream of the catalyst in the exhaust passage and that out puts a value corresponding to the air-fuel ratio of exhaust gas entering the catalyst; and an electromotive force type oxygen concentration sensor that is provided downstream of the catalyst in the exhaust passage and that outputs a value corresponding to the air-fuel ratio of exhaust gas flowing out of the catalyst, wherein the air-fuel ratio control system comprises:

an output value estimation portion that estimates the output value of the oxygen concentration sensor using a catalyst model that estimates an oxygen storage amount of the catalyst and an oxygen concentration sensor model that estimates the output value of the oxygen concentration sensor based on the estimated oxygen storage amount;

an integral value calculation portion that calculates an integral value of deviation which is updated by integrating a difference between an actual output value of the oxygen concentration sensor and the estimated output value;

a correction value calculation portion that calculates based on at least the integral value of deviation, a feedback correction value for correcting a value corresponding to the output value of the air-fuel ratio sensor and/or a target air-fuel ratio; and an air-fuel ratio control portion that performs a control so that the air-fuel ratio of the exhaust gas entering the catalyst is equal to the target air-fuel ratio by controlling a first deviation to be zero the first deviation being obtained by correcting a difference between a detected air-fuel ratio detected based on the output value of the air-fuel ratio sensor and the target air-fuel ratio, using the feedback correction value.

11. The air-fuel ratio control system for the internal combustion engine according to claim 10, wherein the output value estimation portion estimates the estimated output value by inputting, to the catalyst model, a value of the excess or deficiency of oxygen in exhaust gas entering the catalyst, the excess or deficiency of oxygen in exhaust gas entering the catalyst being obtained from the first deviation.

12. The air-fuel ratio control system for the internal combustion engine according to claim 10, wherein the correction value calculation portion calculates the feedback correction value based on the integral value of deviation and a difference between the actual output value of the oxygen concentration sensor and a target value of the output value, which is corresponding to the target air-fuel ratio.

13. The air-fuel ratio control system for the internal combustion engine according to claim 10, wherein the correction value calculation portion calculates the feedback correction value based on the integral value of deviation and a difference between the actual output value of the oxygen concentration sensor and a target value of the output value which is corresponding to the target air-fuel ratio; and the output value estimation portion estimates the output value by inputting, to the catalyst model, a value of the excess or deficiency of oxygen in exhaust gas entering the catalyst, the excess or deficiency of oxygen in exhaust gas entering the catalyst being obtained from a second deviation that is obtained by correcting the difference between the detected air-fuel ratio and the target air-fuel ratio using the integral value of deviation.

14. The air-fuel ratio control system for the internal combustion engine according to claim 10, wherein the oxygen concentration sensor model, which is used by the output value estimation portion, sets the estimated output value to a value indicating a lean air-fuel ratio or a value indicating a rich air-fuel ratio such that the estimated output value is inverted from the value indicating a rich air-fuel ratio to the value indicating a lean air-fuel ratio when the oxygen storage amount has exceeded a first reference value while the estimated output value is inverted from the value indicating a lean air-fuel ratio to the value indicating a rich air-fuel ratio when the oxygen storage amount has fallen below a second reference value that is smaller than the first reference value.

15. The air-fuel ratio control system for the internal combustion engine according to claim 14, wherein the integral value calculation portion does not update the integral value of deviation when the actual output value of the oxygen concentration sensor is within a predetermined range including a target value of the output value, which is corresponding to the target air-fuel ratio.

16. The air-fuel ratio control s stem for the internal combustion engine according to claim 10, wherein the catalyst model, which is used by the output value estimation portion, estimates the oxygen storage amount of the catalyst using a maximum oxygen storage capacity of the catalyst which is a maximum amount of oxygen that can be stored in the catalyst; and the integral value calculation portion does not update the integral value of deviation before the maximum oxygen storage capacity is determined.

17. The air-fuel ratio control s stem for the internal combustion engine according to claim 16, wherein before the maximum oxygen concentration capacity is determined, the correction value calculation portion calculates the feedback correction value based on an integral value that is updated by integrating a difference between the actual output value of the oxygen concentration sensor and a target value of the output value, which is corresponding to the target air-fuel ratio, instead of the integral value of deviation.

* * * * *